US006199572B1

(12) United States Patent
Rousselle et al.

(10) Patent No.: US 6,199,572 B1
(45) Date of Patent: Mar. 13, 2001

(54) COLLAPSIBLE SHELTER/TENT WITH FRAME LOCKING MECHANISM

(75) Inventors: Gisele B. Rousselle; Dennis C. Surrendi, both of St. Albert (CA)

(73) Assignee: Negocios de Estela S.A. (CR)

( * ) Notice: Subject to any disclaimer, the term of this patent is extended or adjusted under 35 U.S.C. 154(b) by 0 days.

(21) Appl. No.: 09/122,115

(22) Filed: Jul. 24, 1998

(51) Int. Cl.[7] ..... E04H 15/28

(52) U.S. Cl. ..... 135/128; 135/126; 135/135; 135/136; 135/143; 135/98

(58) Field of Search ..... 135/126, 128, 135/135, 136, 143, 144, 147, 159, 98

(56) References Cited

U.S. PATENT DOCUMENTS

| | | |
|---|---|---|
| 39,116 | 7/1863 | Carrier . |
| 673,568 | 5/1901 | Reinhold . |
| 709,528 | 9/1902 | Webber . |
| 840,483 | 1/1907 | Earnshaw . |
| 1,124,420 | 1/1915 | Gough . |
| 1,269,413 | 6/1918 | Finnigan . |
| 1,414,616 | 5/1922 | Beehler . |
| 1,502,898 | 7/1924 | Berg . |
| 1,618,851 | 2/1927 | Thunberg et al. . |
| 1,695,009 | 12/1928 | Cochran . |
| 2,117,947 | 5/1938 | de Rome et al. . |
| 2,220,610 | 11/1940 | Miller . |
| 2,483,660 | 10/1949 | Morris et al. . |
| 2,771,087 | 11/1956 | Simonson . |
| 2,804,633 | 9/1957 | Taylor et al. . |
| 2,974,965 | 3/1961 | Welles, Jr. . |
| 3,105,505 | 10/1963 | Maybee . |
| 3,223,098 | 12/1965 | Dole, Jr. . |
| 3,330,582 | 7/1967 | Morris . |
| 3,454,021 | 7/1969 | Morris . |
| 3,721,462 | 3/1973 | Pawlitzki . |
| 3,929,146 | 12/1975 | Maiken . |
| 4,131,381 | 12/1978 | Alberts . |
| 4,202,363 | 5/1980 | Watts et al. . |
| 4,277,934 | 7/1981 | Rieck . |
| 4,372,703 | 2/1983 | Szostak . |
| 4,637,748 | 1/1987 | Beavers . |
| 4,645,372 | 2/1987 | Suzuki . |
| 4,674,523 | 6/1987 | Glatz . |
| 4,906,123 | 3/1990 | Weskamp et al. . |
| 4,945,936 | 8/1990 | Surrendi . |
| 5,230,358 | 7/1993 | Forell . |
| 5,871,026 * | 2/1999 | Lin ..... 135/98 |

* cited by examiner

*Primary Examiner*—Beth A. Stephan
*Assistant Examiner*—Phi Dieu Tran A
(74) *Attorney, Agent, or Firm*—Rothwell, Figg, Ernst & Manbeck, p.c.

(57) ABSTRACT

A collapsible shelter/tent, such as for example an umbrella tent, has a collapsible frame with a plurality of legs that are erected by manually moving two clevises toward one another. The shelter/tent includes an improved locking mechanism that very securely maintains the structure in an erected position. The improved locking mechanism includes a generally vertical pin extending from one of the clevises that is received inside a socket supported on the other of said clevises. The socket has an engaging member therein that can engage a groove in the generally vertical pin after said generally vertical pin has been inserted into said socket. Preferably, the engaging member is spring biased into the groove. The shelter/tent also includes a variety of novel frame structures. An erection device for erecting a collapsible tent is also included. The erection device includes an elongated pole and a slide member that can be used to control relative movement of the clevises toward and away from one another.

18 Claims, 23 Drawing Sheets

COLLAPSIBLE SHELTER/TENT WITH FRAME LOCKING MECHANISM

BACKGROUND OF THE INVENTION

1. Field of the Invention

The present invention relates to collapsible shelters and tents having sheet material walls supported by a collapsible frame. The present invention provides, among other things, an improved collapsible shelter or tent having a frame locking mechanism.

2. Background of the Invention

Collapsible tents, such as umbrella tents, are well known in the art. The term "umbrella tent" is commonly used in the trade because the frames for'such tents can be erected and collapsed in much the same manner as an umbrella. Some exemplary collapsible tents are shown in, for example, U.S. Pat. Nos.: 5,230,358 (Forell); 4,945,936 (D. Surrendi); 4,202,363 (Watts et al.); 3,929,146 (Maiken); and 2,771,087 (Simonson).

U.S. Pat. No. 5,230,358 shows a foldable tent and frame therefor that includes a number of complex drive mechanisms to move upper and lower spiders 14 and 16, respectively, toward and away from one another to erect and collapse the tent frame. The drive mechanisms also include a locking mechanism for securing the spider assembly in an erected condition.

U.S. Pat. No. 4,945,936 shows a collapsible tent having a frame with an upper clevis member 10 and a lower clevis member 11 that are manually moved towards and away from one another, without a complex drive mechanism, to erect and collapse the tent. The '936 tent does not contain, however, a separate locking mechanism to lock the upper and lower clevis members together. In order to assemble the tent, the tent is initially in a position like that shown in FIG. 2. The lower clevis member 11 is then forced up towards the upper clevis member 10. The structure of the tent creates a force resisting upward movement of the lower clevis member 11 towards the upper clevis member 10 until the radial brace members 28 become generally horizontal. Thereafter, the force on the lower clevis member 11 actually causes the lower clevis member 11 to move towards the upper clevis member 10. As a result, in an assembled state as shown in FIGS. 1 and 5, wherein the stop member 26 is seated within the recess 15, the tent is self-sustaining and an additional locking mechanism is not included. The '963 patent can collapse, however, upon the application of a modest downward pressure to the top of the upper clevis member when the frame is assembled.

U.S. Pat. No. 4,202,363 shows an umbrella type collapsible shelter having an upper hub 12 and a lower hub 14 that are moved toward one another to erect the shelter. Similar to the '936 device, when the rib members 15 move past the position perpendicular to the vertical center line of the shelter, the resultant upward force on the hub 14 due to the stress in the bowed support members 11 tends to hold the hub 14 proximate to the central hub 12 to maintain the shelter in the erected position. (See col. 4, lines 45, et seq., of the '363 patent.) In addition, the '363 device includes means for preventing inadvertent collapse of the shelter. In particular, the upper hub 12 includes a bore 23 and the lower hub 14 includes a bore 24 aligned with but eccentric to the bore 23. An erecting means 13 (e.g., an elongated rope or rod) extends through the bores 23 and 24. After the structure is assembled, as stated on col. 6, lines 17 et seq., "[t]he second hub 14 is then rotated by about onequarter to about three-eighths of a turn about the axis of the erecting means" which creates a binding action due to the eccentric relationship. The '363 device, however, has a number of drawbacks—for example: a) the means for preventing inadvertent collapse of the hubs 12 and 14 involves hubs which rotate with respect to one another (and with respect to legs or the like attached thereto); b) the means for preventing inadvertent collapse is complex, unreliable, and can create undue stress on parts; c) the '363 involves mounting the shelter fabric within the frame, creating undue exposure and potential damage of the frame structure and creating other deficiencies.

U.S. Pat. No. 2,771,087 shows a portable screen having a locking mechanism that locks together an upper ridge piece 12 and a lower latching block 24. The locking mechanism of the '087 device also contains a number of drawbacks. In the '087 device, the latching block 24 has an upper cap member 30 with a coil spring 40 that biases loop portions 40 outwardly. The ridge piece 12 includes a central bore 20 that receives the cap member 30. A flexible element 44 is used to pull the cap member 30 vertically through the bore 20 of a ridge piece 12 to lock the latching block 24 to the ridge piece 12 once the loop portions 36 are seated above the screen 54 to lock the device. The drawbacks of the '087 device include, for example, that the locking mechanism can be: a) disadvantageously exposed to the environment; b) inconvenient since disassembly should be initiated from outside of the shelter; and c) undesirable because it involves mounting the frame outside of the screen 54 which reduces the design options of the device.

There remains a need in the art for the continued improvement of collapsible shelters and tents and, for example, for a collapsible shelter or tent having an improved means for locking a frame thereof in an assembled state.

SUMMARY OF THE INVENTION

The present invention provides a variety of features that overcome the above-noted problems and many other problems existing in the art.

A first aspect of the invention involves the provision of a collapsible shelter/tent that has an improved means for locking a frame thereof in an assembled state. In this regard, a collapsible shelter/tent can be provided that includes: a collapsible frame including: a) three or-more legs pivotally connected to a first clevis; and b) three or more support bars pivotally connected with respect to the legs at an outer end of the support bars and pivotally connected to a second clevis at an inner end of the support bars; a locking mechanism for locking the first and second clevises together when the shelter/tent is assembled which includes: a) a generally vertical pin extending from one of the first and second clevises, the generally vertical pin having a groove on a side thereof; b) a socket on the other of the clevises having a receiving bore aligned with the generally vertical pin; c) an engaging member supported within the socket that can firmly engage the groove in the generally vertical pin after the generally vertical pin is inserted into the socket; and a plurality sheet-material walls supported on the collapsible frame.

Preferably, the collapsible shelter/tent includes biasing means for biasing the engaging member into the groove automatically upon engagement of the first and second clevises.

In one exemplary embodiment, the first clevis is above the second clevis and the generally vertical pin extends downward from the first clevis towards the second clevis. Preferably, the socket is fixed to the second clevis and includes a central bore and a widened opening having a funnel-shape receiving surface. The diameter across the widened opening having the funnel-shape receiving surface is preferably substantially greater than a diameter across the vertical pin to ensure engagement and can be, for example, more than 2 times, or even more than 2.5 times, or even more than 3 times as great.

According to another aspect of the invention, an erection device is provided that includes: an assembly pole having a slide supported thereon; the assembly pole having a tip with an engagement element; the generally vertical pin having a lower end with a corresponding engagement element for engaging the tip of the assembly pole; and the second clevis and the socket having a through-hole through which the assembly pole is insertable so that the tip of the assembly pole can be engaged with the generally vertical pin.

The present invention has a number of advantages not found in the references. A number of these advantages are discussed below. The following advantages are found in the more preferred embodiments, but are not absolutely required in every embodiment of the invention.

The present locking mechanism can be embodied substantially within a lower clevis assembly which can, for example, receive a downward protruding pin from the upper clevis member.

The present locking mechanism allows the frame to be located either inside or outside of the shelter/tent sheet-material (e.g., fabric, etc.) walls.

The present locking mechanism does not need to be exposed to the environment since, for example, the locking mechanism can be internalized within the clevis assembly, and notably substantially within the lower clevis member. The frame and locking mechanism is thus less likely to become corroded, to accumulate dirt or dust, etc., which could negatively effect the device or its operation.

The present device is also more convenient for the user because the user can unlock the device from a position within the shelter/tent.

The present invention also does not require an external element such as a chord or the like so that the present design can be mounted either inside or outside of the shelter/tent sheet-material walls.

The above and many other aspects, features and advantages of the present invention are further presented in the detailed description of the preferred embodiments of the invention which follows.

BRIEF DESCRIPTION OF THE DRAWINGS

FIG. 2(A) illustrates a cross-sectional side view of the locking mechanism;

FIG. 2(B) shows a side view of a pin-holding element that can be used in this first preferred locking mechanism;

FIG. 2(C) shows a side view of a pin that can be used in this first preferred locking mechanism;

FIG. 3(A) shows a side view of a vertical locking pin usable in this second locking mechanism;

FIG. 3(B) shows a cross-sectional top view taken along the axis 3B—3B shown in FIG. 3(D);

FIG. 3(C) shows a side view of a clevis structure usable for the upper and lower clevises;

FIG. 3(D) illustrates a cross-sectional side view of the locking mechanism taken along the axis 3—3 shown in FIG. 3(B);

FIG. 4(A) shows a cross-sectional bottom view taken along the axis 4A—4A in FIG. 4(B);

FIG. 4(B) is a cross-sectional side view taken along the axis 4—4 in FIG. 4(A);

FIG. 4(C) is a schematic side view showing a portion of the locking mechanism;

FIG. 11(A) illustrates the end views such connecting members;

FIG. 11(B) is a side view of one connecting member having an angled end;

FIG. 11(C) illustrates the side views of the connecting member from the direction of the arrow 11C shown in FIGS. 11(B), 11(D) and 11(E);

FIG. 11(D) is a side view similar to that shown in FIG. 11(B) of a connecting member having a modified end;

FIG. 11(E) is a side view similar to that shown in FIG. 11(B) of another connecting member having a modified end;

FIGS. 23(A)–23(E) show a gradual progression as the slide is moved upward along the assembly pole of the erection device;

FIG. 23(F) shows the erection device removed from an erected shelter/tent; and FIG. 23(G) shows the erection device being stored along a side of the shelter/tent.

DETAILED DESCRIPTION OF THE INVENTION

Figure 1A:
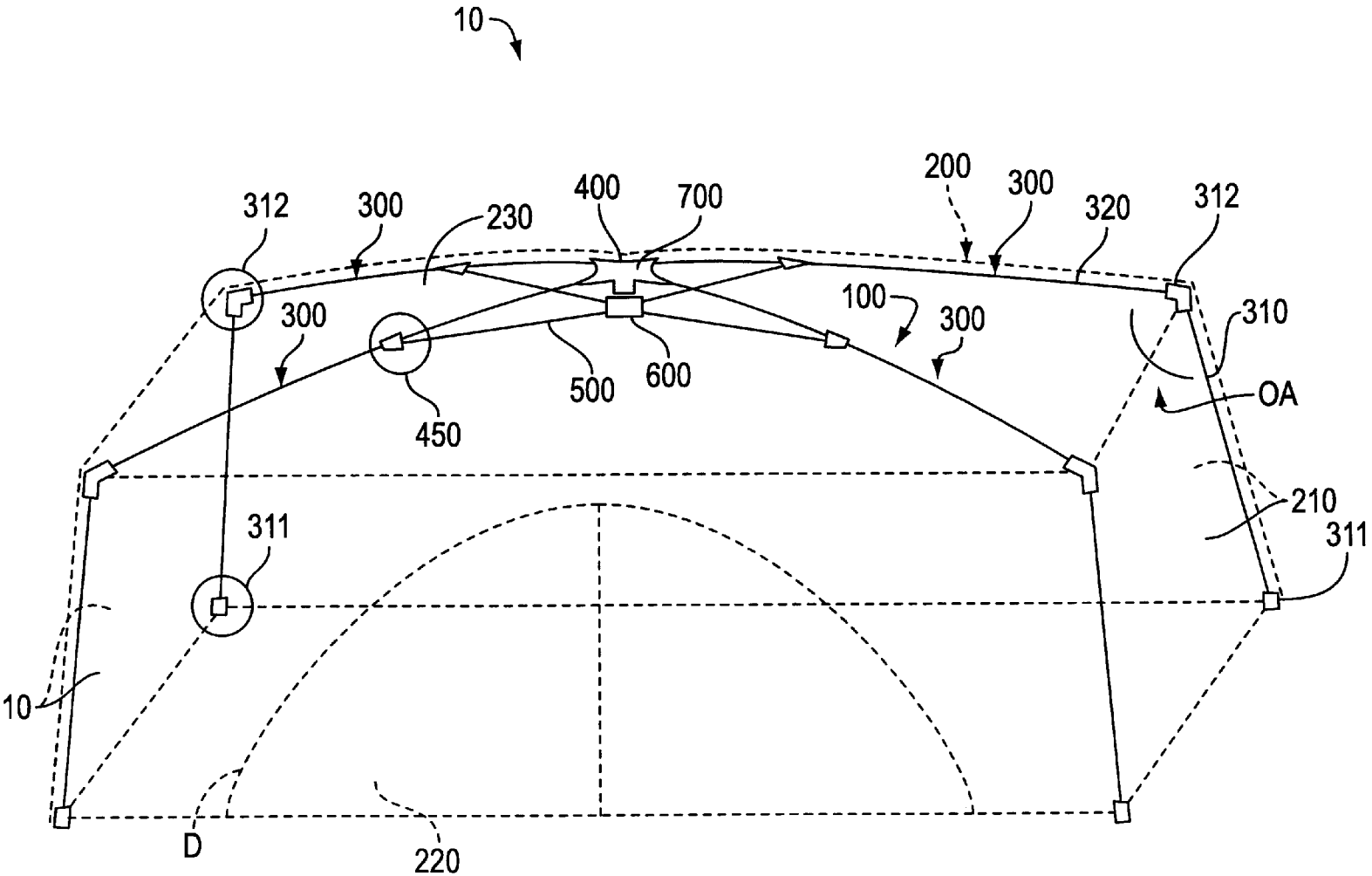
FIG. 1(A) is a schematic perspective view according to an exemplary embodiment of the invention having a rectangular base.

In addition to reference numerals identifying aspecific parts as discussed herein, FIGS. 2–17 also include reference numerals referring to sizes, in inches, as well as angles, in degrees, according to exemplary embodiments of the invention. These FIGS. are also illustrated in proportional size ratios according to exemplary embodiments. These exemplary sizes, angles and ratios are provided for illustrative purposes and are not intended to limit the wide range of the invention, which can vary greatly between various embodiments.

Figure 1B:
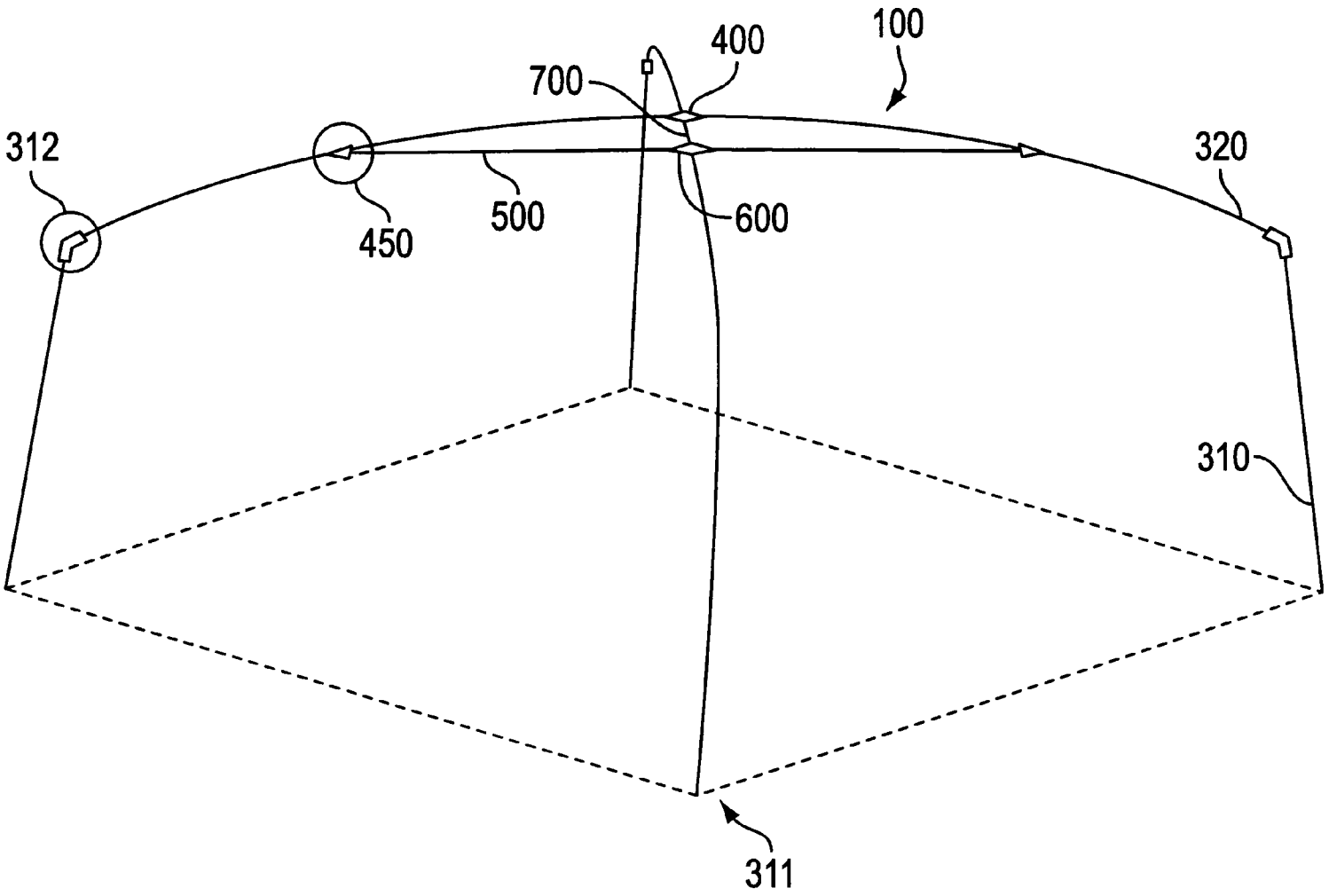
FIG. 1(B) is a schematic perspective view according to an exemplary embodiment of the invention having a square base.
Figure 1C:
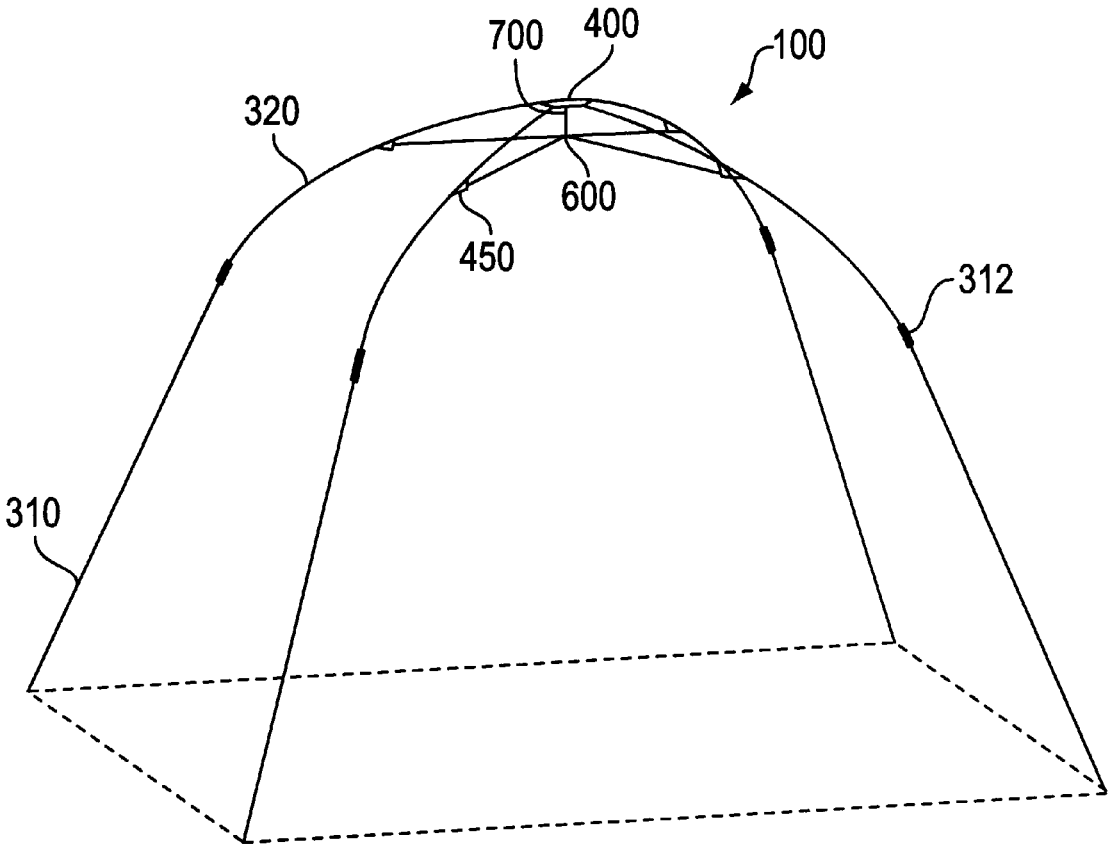
FIG. 1(C) is a schematic perspective view according to another exemplary embodiment of the invention having a square base and a dome-shaped top.

FIGS. 1(A)–1(C) show shelters/tents 10, according to exemplary embodiments of the invention, each having a collapsible frame 100 that supports a sheet-material cover 200 (shown in dashed lines in FIG. 1(A)). In the preferred embodiments, the sheet-material cover 200 is supported outside of the frame, but the sheet-material cover 200 can also be mounted inside of the frame (not shown), or covers could be provided both inside and outside of the frame (appropriate access there-through should be provided).

The sheet-material cover 200 can be made with any known sheet-materials, including any known sheet-materials commonly used for constructing shelters and tents. These materials can include, as some examples, synthetic fabrics, nylon fabrics, polyester fabrics, plastic sheets, natural fiber sheets, cloth sheets, canvas sheets, etc. As shown in FIG. 1(A), the sheet material cover preferably includes a plurality of sides 210 and a ceiling 230. As shown in dashed lines, one or more of the sides can include a door D, a window or the like access means. In addition, the cover 200 can also include a floor 220. The floor 220 can be omitted or can be optional in certain embodiments. In addition, as long as the cover 200 imparts the necessary forces (discussed below), portions of the sides 210 and the ceiling 230 can be omitted as desired.

The collapsible frame 100 preferably includes four supporting legs 300 that are pivotally attached to an upper clevis 400. Although four legs are preferred, the frame can have only three legs or can have five or more legs. In the embodiments shown in FIGS. 1(A)–1(C), each of the legs 300 includes a leg tube 310 extending from a tent foot 311 to a hinge 312 and a band bar 320 extending from the hinge 312 to the upper clevis 400. Each of the legs 300 also includes a hinge 450 that pivotally supports an outer end of a center tube 500, while an inner end of the center tube 500 is pivotally connected to a lower clevis 600.

According to a first aspect of the present invention, the upper and lower clevises 400 and 600 are locked together via a novel locking mechanism 700.

Figure 2A:
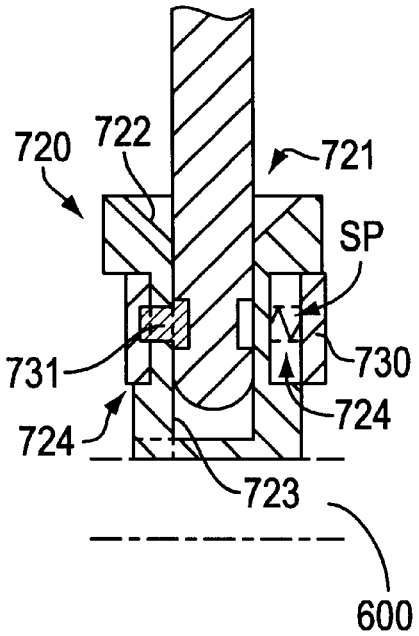
FIGS. 2(A)–2(C) show elements of a first preferred locking mechanism according to certain embodiments of the present invention.
Figure 2B:
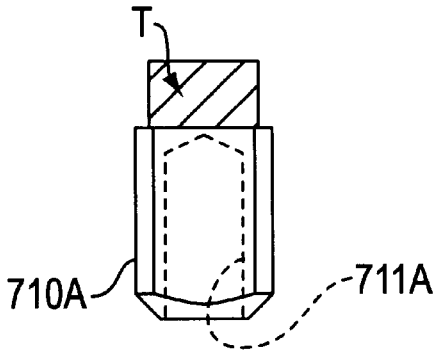
Figure 2C:
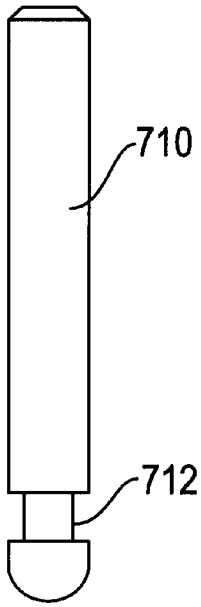
Figure 5:
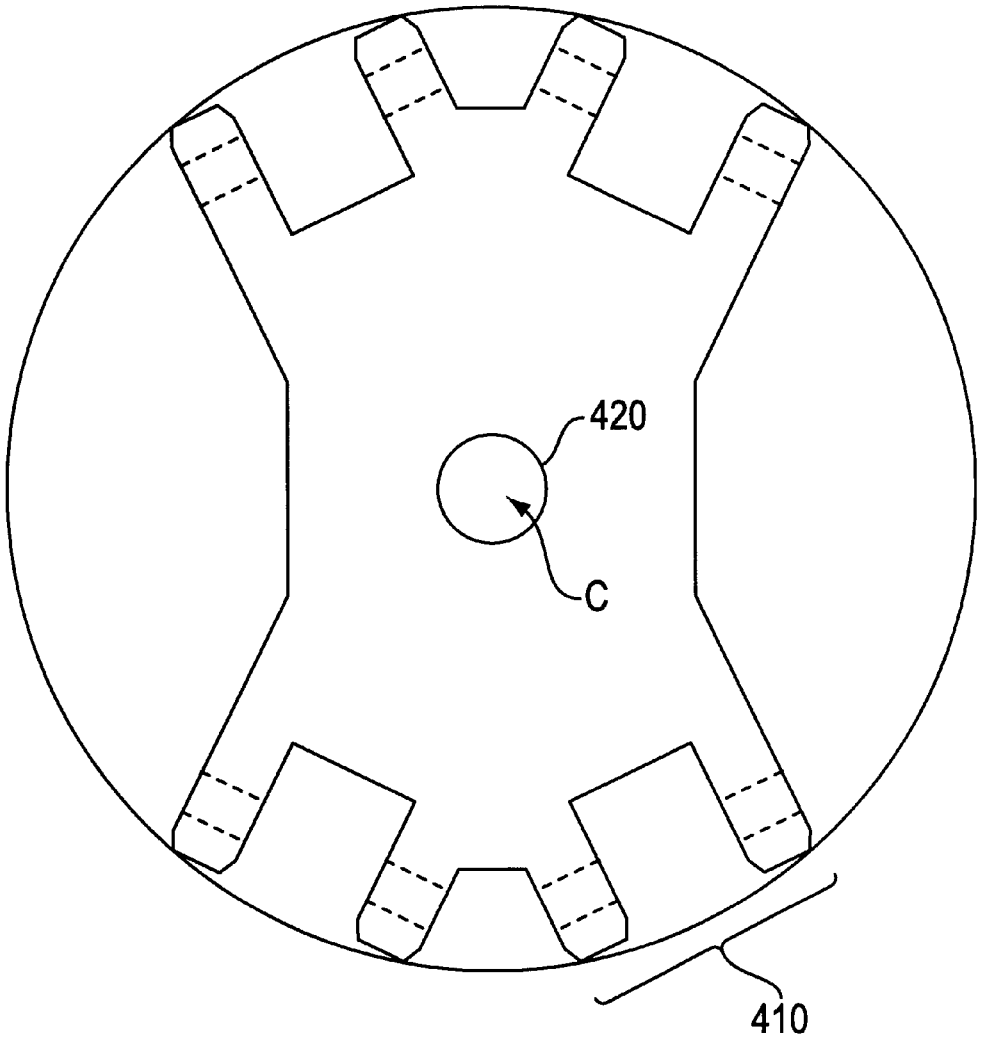
FIG. 5 is a plan view of a clevis for constructing a rectangular shelter/tent according to one exemplary embodiment.

FIGS. 2(A)–2(C) show a first embodiment of the locking mechanism 700. In this first embodiment, the locking mechanism 700 includes a pin 710, FIG. 2(C), fixed to the upper clevis 400 and a lock housing or socket 720 fixed to the lower clevis 600, FIG. 2(A). As shown in FIG. 5, for example, the upper clevis 400 can include a hole 420 and pin-holding element 710A, FIG. 2(B), can be pressed, screwed, welded or otherwise fixed within the hole 420, while the pin-holding element 710A can include a receiving bore 711A into which the pin 710 is pressed, screwed, welded or otherwise fixed. Preferably, the pin-holding element 710A includes threads T that are screwed into corresponding threads in the upper clevis 400. The outer surface of the pin-holding element 710A can be hexagonal, gnarled, or otherwise configured to facilitate screwing it to the upper clevis 400. It is contemplated, however, that the pin 710 can also be fixed directly to the upper clevis 400, such as being pressed, threaded or welded directly thereto, or can be fixed thereto in any other known manner.

The socket 720 preferably includes a receiving opening 721 having an funnel-shape guide surface 722 and a central bore 723 that is sized to receive the pin as shown in FIG. 2(A). The socket 720 also includes an annular recess 724 and a ring 730 that is retained in, yet laterally displaceable along, the annular recess 724. A spring SP (such as a compressed coil spring as shown or any other known spring or biasing means) preferably biases the ring 730 so that the pin 731 extends through a lateral hole in the socket member 720 into a groove 712 in the center pin 710 to lock the upper and lower clevises 400 and 600 together (i.e., the spring SP biases the pin 731 rightward in FIG. 2(A)).

In order to disengage the clevises, the ring 730 can be moved laterally, e.g., moved manually leftward in FIG. 2(A), against the force of the spring SP to disengage the pin 731 from the groove 712 in the center pin 710.

Figure 3A:
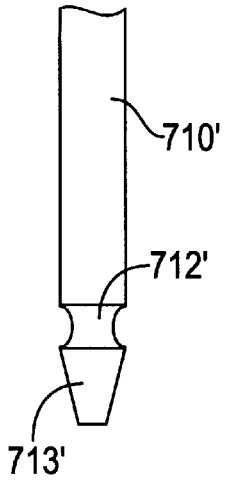
FIGS. 3(A)–3(D) show elements of a second preferred locking mechanism according to certain embodiments of the present invention.
Figure 3B:
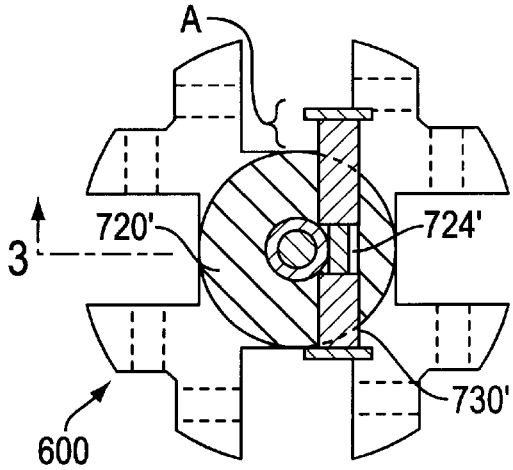
Figure 3C:
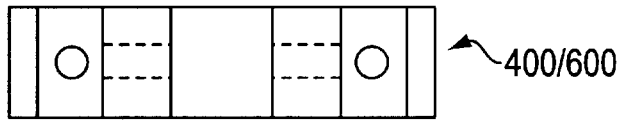
Figure 3D:
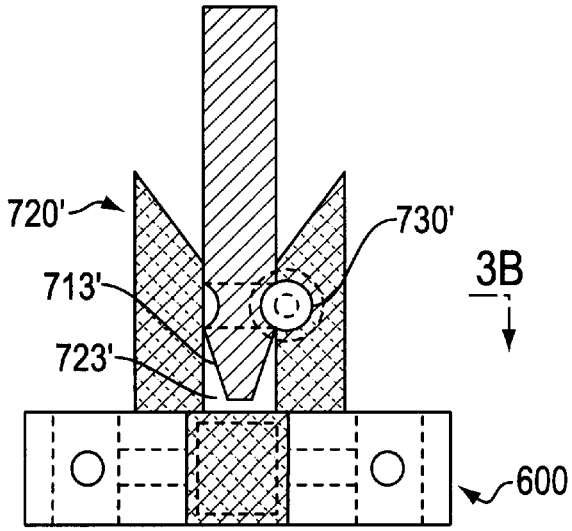

A second embodiment of the locking mechanism 700 is shown in FIGS. 3(A)–3(D). In this second embodiment, the upper clevis 400 has a depending vertical center pin 710' with an annular groove 712' and the lower clevis 600 has an upstanding socket 720' for receiving the pin 710'. As with the preceding embodiment, the pin 710' can be fixed to the upper clevis 400 in a variety of ways. The socket 720' includes a vertical bore 723' that receives the pin 710' and also includes a lateral bore 724', FIG. 3(B), that slidingly receives a sliding pin 730'. As shown in FIG. 3(B), the sliding pin 730' has a narrow section that allows the vertical center pin 710' to pass and a wide section that restricts movement of the vertical center pin 710' when located within the annular groove 712' in the vertical center pin 710'.

The vertical center pin 710' has a tapered end portion 713' that can move the sliding pin 730' laterally within the bore 724' during engagement. In order to engage the wide section of the sliding pin 730' with the groove 712', a user can manually move the pin 730' to a locked position. Alternatively, a spring (not shown) could be used to bias the pin 730' into the locked position. The sliding pin 730' can then be manually moved to an unlocked position disengage the device.

The sliding pin 730', or a portion of the socket or housing 720' proximate thereto, can also be color coded for visual identification of the unlocked and locked positions of the sliding pin—as one example, the end region A can be colored green so that one can easily discern that the assembly is unlocked when the side A protrudes as shown in FIG. 3(B), while, for example, the opposite end of the pin can be colored red so that one can easily discern that the assembly is locked when that opposite side protrudes. The other embodiments of the locking mechanism 700 discussed herein can also include similar color coding to facilitate observance of the locked positions and the unlocked positions of the locking mechanism 700.

Figure 4A:
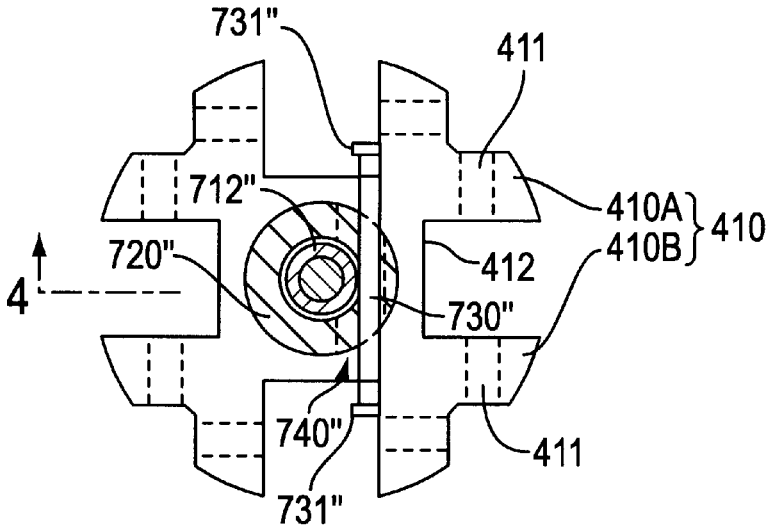
FIGS. 4(A)–4(C) show elements of a third preferred locking mechanism according to certain embodiments of the invention.
Figure 4B:
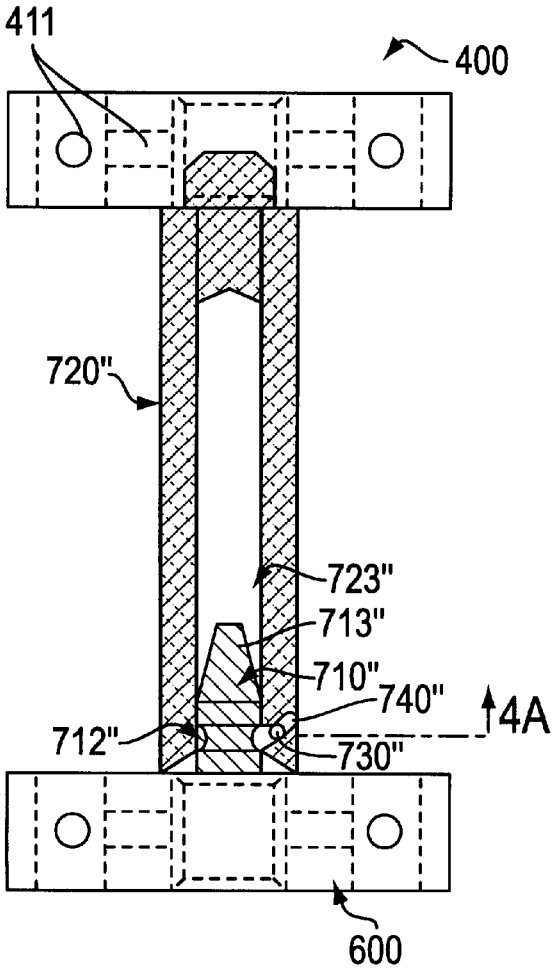
Figure 4C:
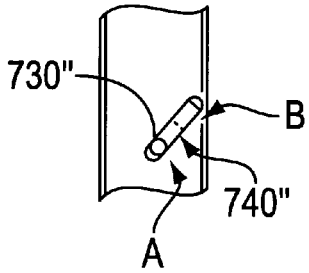

A third embodiment of the locking mechanism 700 is shown in FIGS. 4(A)–4(C). In this third embodiment, the lower clevis 600 has a vertical center pin 710" with a tapered top end 713" which enters a bore 723" in a vertical shaft 720" connected to the upper clevis 400. Upon insertion, the tapered top end 713" moves a horizontal pin 730" laterally within an inclined slot 740" in the shaft 720". The outer ends of the pin 730" can include widened portions 731", or the like, to prevent the pin 730" from falling from the slot 740". In contrast to the second embodiment, the locking pin 730" moves in a direction generally perpendicular to the axis of the pin 730". When engaged, the pin 730" returns via gravity (falls within the inclined slot 740") into the groove 712" of the pin 710" to lock the devises together. Once again, in alternative constructions, a biasing means (not shown) could also be used to bias the pin 730" into its locked position. The locking pin 730" can be manually moved (e.g., rightward in FIG. 4(C) from a position A to a position B) to disengage the pin 730" from the groove 712" in the center pin.

Other embodiments of the locking mechanisms 700 can be made by combining or modifying the above exemplary embodiments of the locking mechanism. As some exemplary although less preferred modifications, the locking pins 710, 710' and/or 710" can be modified to extend from the other of the upper or lower clevises and the parts can be, thus, reversed.

Preferably, the locking mechanisms include: a) a pin member extending from one of the clevis members; b) a socket member on the other of the clevis members; c) the socket member preferably has an engaging member that can firmly engage a groove or hole in the pin upon insertion of the pin member into the socket member (preferably, the engagement is automatically imparted via a spring and/or via another biasing means such as gravity or the like); d) the engaging member is preferably manually releasable. In addition, the manual release is preferably performed proximate the lower clevis member to facilitate access thereto.

Among other things, the present locking mechanisms 700 can be beneficially located inside the shelter/tent structure (e.g., within sheet-material walls of a shelter/tent). The structure of the locking mechanisms can advantageously limit the accumulation and/or effect of debris (e.g., dust or dirt) that could otherwise interfere with the operation of the device. The locking mechanisms can also be highly accurate, consistent and fail-safe.

The pin 710, the upper and lower clevises 400 and 600, the socket 720, and the pins 730, 730' and 730" are preferably made with strong materials, such as with metals (such as aluminum, stainless steel, or other metals), composite materials and the like. Most preferably, the materials are rust-proof, rust-protected, and/or non-corrosive.

The present invention has significant advantages, for example, in military applications wherein substantial shelters/tents need to be erected quickly and without difficulty or trouble. Similarly, the present invention also has significant advantages in disaster-relief applications, wherein shelters/tents are used to accommodate and/or care for individuals or the like in disaster situations, such as during floods, earthquakes, warfare, etc. The present invention also has substantial advantages for recreational uses (e.g., camping, mountaineering, hunting, etc.) and in other common uses of shelters and/or tents. The present invention thus has broad applicability to various shelters, tents, hunting blinds, covers, screens and the like. The terminology "shelter/tent" is defined herein to encompass any such structures.

The above-described locking mechanisms 700 can be incorporated into a variety of shelter/tent structures having upper and lower clevises. The various shelters can range in sizes from single person tents, or smaller, that are only a few feet high to large tents having ceiling heights of eight to ten feet or even substantially greater. A number of exemplary shelter/tent structures into which such a locking mechanism can be incorporated are discussed hereinbelow.

In one type of preferred embodiment, the shelter/tent structure has four sides and, hence, four legs 300. In that regard, the upper and lower clevises can be modified appropriately to pivotally support a desired number of legs 300. In another type of preferred embodiment, the shelter/tent structure has six sides and, hence, six legs 300. The number of legs, however, can be selected as desired and can be any number that is three or more. The embodiments shown in FIGS. 3(B) and 4(A), discussed below, show clevises that operate with four legs, and, more preferably, four legs of equal length to create a shelter/tent covering a generally square ground area. On the other hand, the embodiment shown in FIG. 5 shows a clevis that operates with four legs of equal length to create a shelter/tent covering a generally rectangular ground area, such as shown for example in FIG. 1.

The particular embodiment shown in FIG. 5 has two pairs of band-bar mounts 410 for attaching the legs 300. The band-bar mounts 410 are preferably situated along a common circle (such that forces from the legs 300 are directed to a common center C). In the illustrated exemplary construction, each pair of mounts is about 53° from one another and about 127° from the mounts of the other pair. The clevis shown in FIG. 5 can be used for example to construct a tent having a base of about 4 feet by 8 feet, like that shown in FIG. 1 for example. As noted above, the sizes, angles and ratios illustrated in the FIGS. are with respect to exemplary embodiments, and these exemplary sizes, angles and ratios can be varied greatly between various embodiments to yield a wide range of shelter/tent sizes and shapes.

The upper and lower clevises are preferably constructed to have generally like shapes in each of the embodiments. In the embodiment shown in FIG. 4(A), for example, the upper and lower clevises can be constructed with a similar "snowflake" shape. The shapes and/or sizes of the upper and lower clevises, however, can of course be made to be different from one another under various circumstances.

As shown in FIG. 4(A), the clevis 400 includes four symmetrical bar mounts 410 of equal size situated 90 degrees apart from one another. The bar mounts 410 are made up of a pair of protrusions 410A and 410B. Each protrusion 410A and 410B includes a through-hole 411 for pivotally mounting the legs 300 as discussed below.

Figure 6A:
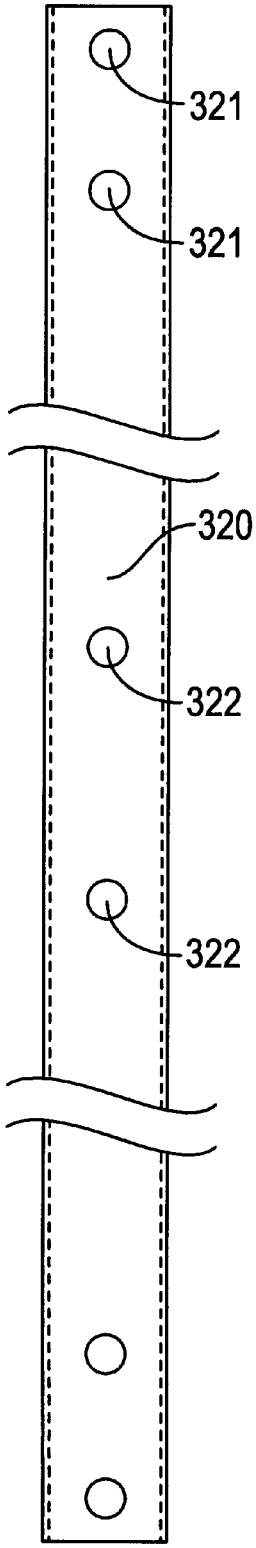
FIG. 6(A) is a plan view of a band bar that is used to construct an upper portion of a leg for a shelter/tent according to one exemplary embodiment.
Figure 6B:
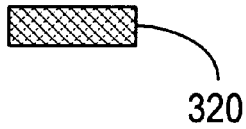
FIG. 6(B) is a cross-sectional view of the band bar taken along the line 6—6 shown in FIG. 6(A)

As shown in FIGS. 1, 6(A) and 6(B), the legs 300 preferably have upper band bars 320 that are pivotally connected to the bar mounts 410 of the upper clevis 400. The legs 300 preferably also include holes 321 that are used to attach a connecting member 330 like that shown in FIG. 8(C). The connecting member 330 includes a through-hole 331 that is aligned with the through-holes 411 and also includes through-holes 332 that are aligned with the through-holes 321 of the band bar 320. The inside surface 412 of each bar mount 410 of the clevis 400 is preferably spaced sufficiently away from the end 333 of the member 330 so as not to contact the same during the rotation of the member 330 about the axes of the aligned holes 411 and 331. In this regard, the end 333 is preferably modified to be rounded at both sides as shown in FIG. 8(C).

Preferably, when connected to the upper clevis (e.g., via pins, bolts, or the like) a notched region 334 for receiving the band bar 320 faces upward to provide a smooth upper surface, which is preferable in embodiments wherein a cover 200 is supported thereon.

Figure 10A:
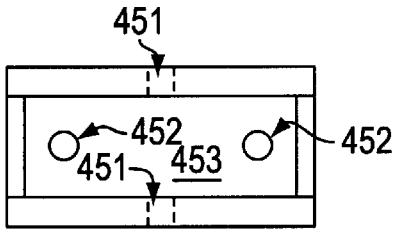
FIG. 10(A) is a top view of another hinge element according to another aspect of the invention.
Figure 10B:
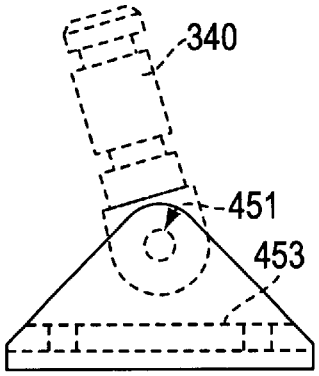
FIG. 10(B) is a side view of the hinge element shown in FIG. 10(A)
Figure 10C:
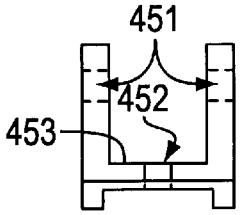
FIG. 10(C) is an end view of the hinge element shown in FIG. 10(A)

As shown in FIG. 1, a connector hinge 450 is located at an intermediate location along the length of each band bar 320 for pivotally supporting an outer end of a support bar or center tube 500. As shown in FIGS. 10(A)–10(C), each connector hinge 450 preferably includes a bracket member having a generally U-shape cross-section, FIG. 10(C), and having hinge-holes 451 and mounting-holes 452. The mounting-holes 452 are aligned with through-holes 322 at an intermediate location along the band bar 320, FIG. 6(A), and screws, bolts or the like (not shown) are used to secure the hinge 450 thereto.

Figure 8A:
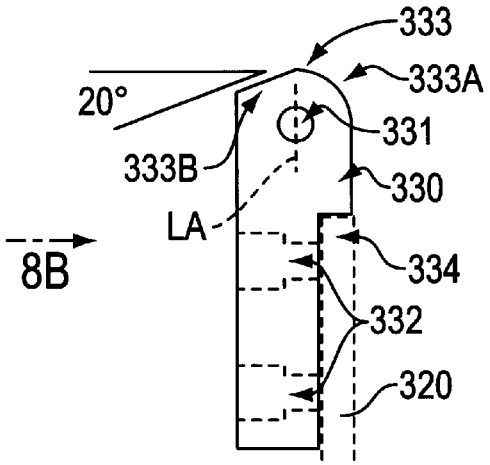
FIG. 8(A) is a side view of a connecting member according to one aspect of the invention.
Figure 8C:
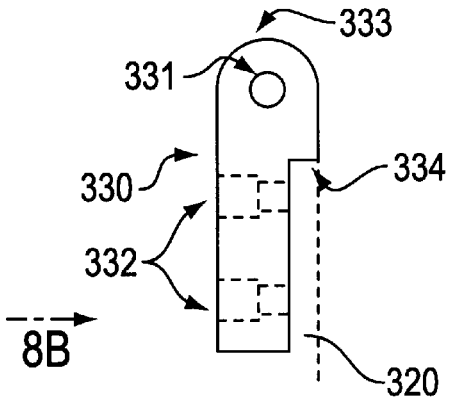
FIG. 8(C) is a side view of a connecting member similar to that shown in FIG. 8(A) with a rounded end configuration.
Figure 8B:
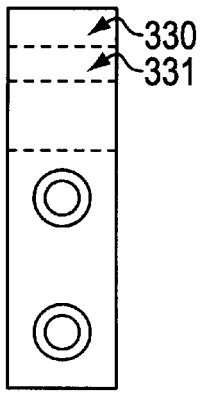
FIG. 8(B) is a side view of the connecting members shown in FIGS. 8(A), 8(C) and 8(D) from the direction of the arrows 8B.
Figure 8D:
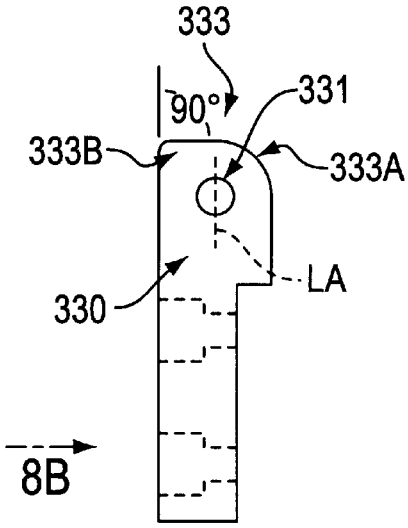
FIG. 8(D) is a side view of a connecting member similar to that shown in FIG. 8(A) with a modified flat-end configuration.

The lower end of the band bars 320 have a second connector member 330 fixed thereto like that shown in FIGS. 8(A) or 8(D). In contrast to the embodiment shown in FIG. 8(C), the end 333 of the second connector member preferably has a rounded side 333A and a flat side 333B like that shown in FIGS. 8(A) or 8(D). The embodiments shown in FIGS. 8(A), 8(C) and 8(D) each have similar views in a direction of the arrows 8B, as seen in FIG. 8(B). FIG. 8(D) illustrates an embodiment wherein the flat side is at an angle of about 90 degrees to the longitudinal axis LA of the member 330. FIG. 8(A) shows an embodiment wherein the flat side 333B is at an angle of about 70 degrees to the longitudinal axis LA. This angle can be selected as desired depending on circumstances, and a variety of other angles can be used. As discussed further hereinbelow, the angle selected can be used to set the opening angle OA, FIG. 1, of the hinge 312. The flat side 333B is used as a stop to prevent further rotation of the connecting member about the connecting piece 313 discussed in the next paragraph. The flat side 333B preferably faces the interior of the shelter/tent while the rounded side 333A preferably faces the exterior of the shelter/tent.

Figure 9A:
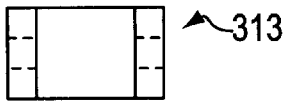
FIG. 9(A) is an end view of a hinge element according to one aspect of the invention.
Figure 9B:
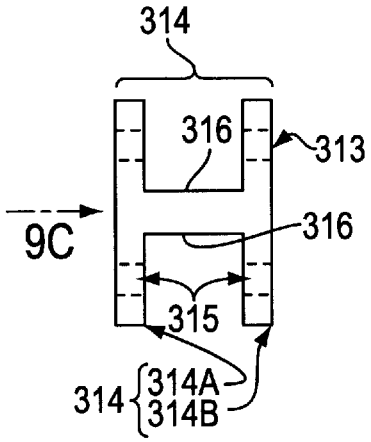
FIG. 9(B) is a side view of the hinge element shown in FIG. 9(A)
Figure 9C:
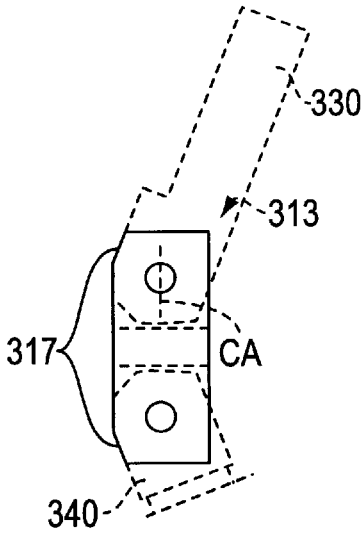
FIG. 9(C) is a side view of the hinge element from the direction of the arrow 9C shown in FIG. 9(B)

As noted, and as shown in FIGS. 9(A)–9(B), the preferred hinge 312 includes a connecting piece 313 having a generally H-shaped cross-section, FIG. 9(B), formed by two opposing bar mounts 314 with left and right sides 314A and 314B and mounting holes 315. The second connecting member 330 at the lower end of the band bar 320 is supported in a first of these bar mounts 314. In this regard, the flat side 333B is arranged to abut one of the surfaces 316 when a predetermined angle is achieved between the axis LA of the member 330 and the axis CA, FIG. 9(C), of the member 313. This enables the hinge to lock open at the predetermined opening angle OA, FIG. 1, when the shelter/tent is erected.

Figure 11A:
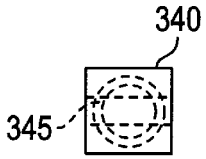
FIGS. 11(A)–11(E) illustrate connecting members according to other aspects of the invention.
Figure 11B:
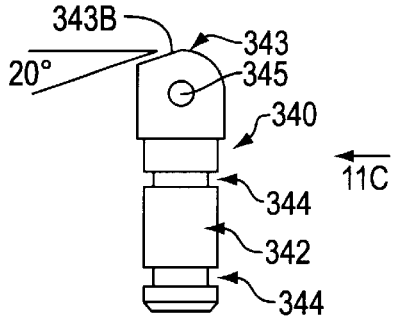
Figure 11C:
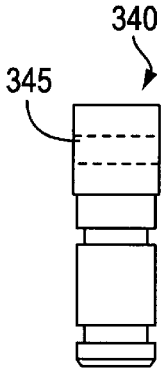
Figure 11D:
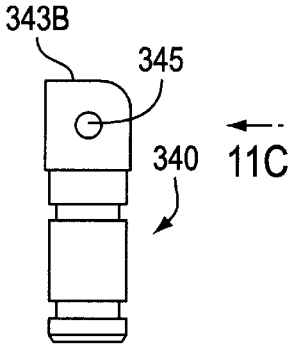

At the second bar mount 314 of the member 313, a connecting member 340 like that shown in FIGS. 11(B) or 11(D), having a top end 343 similar to the top end 333 of the connecting member 330 shown in FIGS. 8(A) or 8(D) and having a generally cylindrical lower end 342 is connected to the connecting piece 313 in a similar manner to the connecting member 330.

Figure 7A:
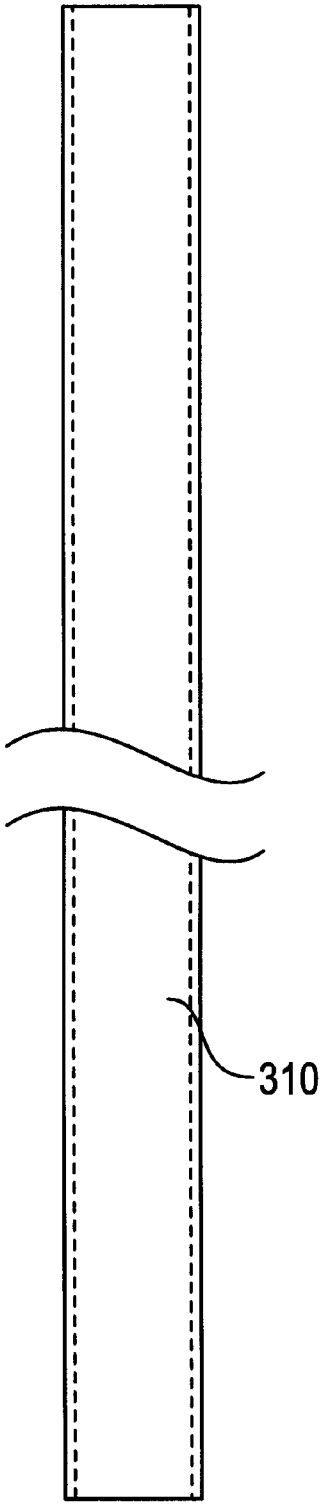
FIG. 7(A) is a plan view of a leg tube that is used to construct a lower portion of a leg for a shelter/tent according to one exemplary embodiment.
Figure 7B:
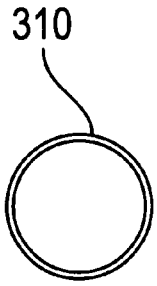
FIG. 7(B) is a cross-sectional view of the leg tube taken along the line 7—7 shown in FIG. 7(A)

The lower end 342 is adapted to fit inside a hollow end of a generally cylindrical leg tube 312, such as shown in FIGS. 1, 7(A) and 7(B). The lower end 342 preferably includes annular grooves 344 for receiving an o-ring to enhance the tightness of the connection and to provide an enhanced seal between the member 340 and the leg tube 310.

In this manner, an angle can be formed between the band bar 320 and the leg tube 310 through the hinge 312. This angle (formed between the axes of the two connecting members 330 and 340) can be in a broad range between about 180 degrees (180 degrees can be provided for instance using elements like that shown in FIGS. 8(D) and 11(D)) and 90 degrees (90 degrees can be provided for instance using elements like that shown in FIGS. 8(A) and 11(B), but with the flat sides 343B angled to create a 90 degree angle, such as both being at 45 degrees). Previously, angles approaching 90 degrees were not workable. The present invention allows angles far closer to 90 degrees than previously possible, and notably angles of less than 155 degrees, and even less than 140 degrees, and even less than 125 degrees, and even less than 110 degrees. As noted, these angles can be selected as desired.

Among other things, the locking mechanism 700 of the present invention allows for an angle much closer to 90 degrees than previously possible. In particular, (a) the ceiling area can be at a lower position without the risk that the weight of the ceiling will cause the structure to collapse and (b) the frame can be locked at a position closer to the location of maximum force against the cover 200 (e.g., closer to the horizontal position of the center tubes 500).

Thus, the present invention enables a shelter/tent to have a corner between a ceiling and a side that is at or near a "right angle", which allows for a substantial increase in useable space inside the structure than with conventional "dome" shape designs.

It is noted that FIGS. 1(A) and 1(B) illustrate exemplary embodiments of rectangular base and square base shelter/tents having an angle approaching 90 degrees, while FIG. 1(C) illustrates an exemplary embodiment having a square base and an angle of about 180 degrees. In the embodiment shown in FIG. 1(C), the flexure of the band bars 320 provides most of the curvature at the juncture between the sides and the ceiling.

The structure of the hinge 312 is an improvement over, for example, the hinge 36 shown in FIG. 8 of U.S. Pat. No. 5,230,358, the disclosure of which is incorporated herein by reference. Although a preferred hinge structure is described, it is contemplated that any appropriate hinge structure could be used in other embodiments.

Figure 13A:
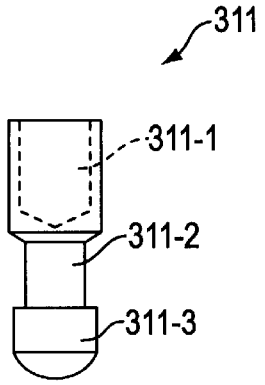
FIG. 13(A) is a side view of a tent foot according to one exemplary embodiment of the invention.
Figure 14A:
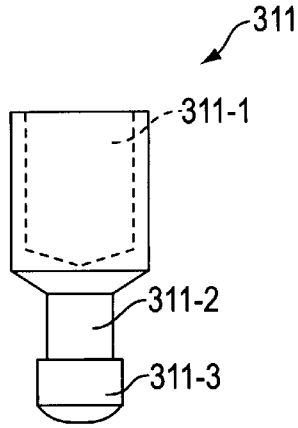
FIG. 14(A) is a side view of a tent foot according to another exemplary embodiment of the invention.
Figure 13B:
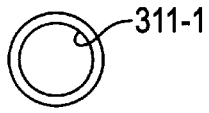
FIG. 13(B) is a top cross-sectional view taken along the line 13—13 shown in FIG. 13(A)
Figure 14B:
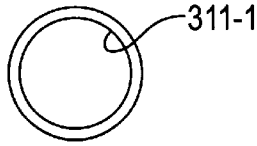
FIG. 14(B) is a top cross-sectional view taken along the line 14—14 shown in FIG. 14(A)
Figure 15A:
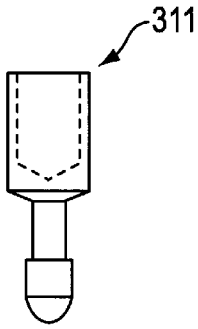
FIG. 15(A) is a side view of a tent foot according to another exemplary embodiment of the invention.
Figure 16A:
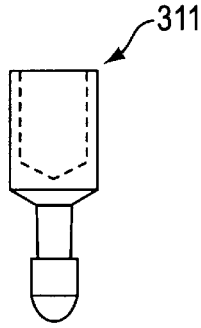
FIG. 16(A) is a side view of a tent foot according to another exemplary embodiment of the invention.
Figure 15B:
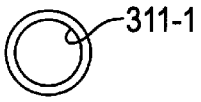
FIG. 15(B) is a top cross-sectional view taken along the line 15—15 shown in FIG. 15(A)
Figure 16B:
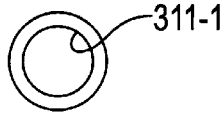
FIG. 16(B) is a top cross-sectional view taken along the line 16—16 shown in FIG. 16(A)
Figure 17:
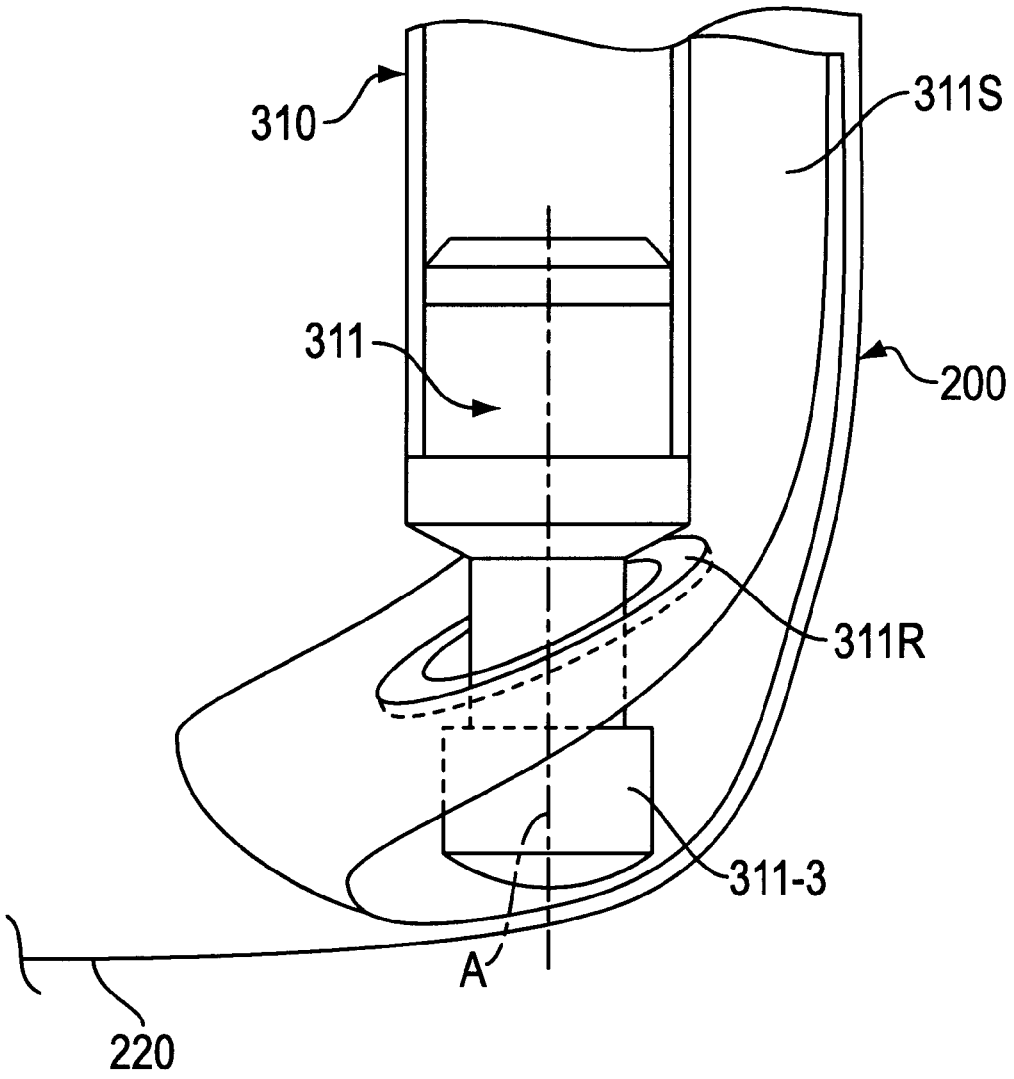
FIG. 17 is a broken away side view of a tent foot fixed at a corner of a shelter/tent.

The lower end of the leg tube 310 preferably has a tent foot 311 secured thereto. FIGS. 13(A)–13(B) illustrate a first embodiment of the tent foot 311. FIGS. 14(A)–14(B) illustrate a second embodiment of the tent foot 311. FIGS. 15(A)–15(B) illustrate a third embodiment of the tent foot 311. And, FIGS. 16(A)–16(B) illustrate a fourth embodiment of the tent foot 311. These embodiments are designed, for example, to accommodate different leg tubes 310. In each of the illustrated preferred embodiments, the tent foot 311 includes an upper socket 311-1, a narrow mid-region 311-2, and a wide bottom-region 311-3. The leg tubes 310 can be received within the socket 311-1, such as being press-fit, threaded, glued, welded, etc., thereto. Alternatively, the tent feet 311 can have a cylindrical top that fits within a hollow end of a leg tube 310, such as shown in FIG. 17. Alternatively, the tent feet could be attached in any other known manner.

The tent feet 311 preferably do not penetrate the cover 200 so as to extend to the ground surface, but are preferably retained within the cover 200. The rounded bottom surface of the tent feet 311 helps prevent damage to any floor 220 material that the feet 311 may contact. In addition, a reinforcement member can be provided between the tent feet 311 and the floor 220 to prevent the tent feet 311 from damaging the floor surface. The reinforcement member can include, for example, as shown in FIG. 17 a metal ring 311R that is received in the region 311-2 and that is supported on a sheet or fabric material 311S sewn or otherwise fixed at a corner of the floor 220. In the preferred embodiment, as shown, the sheet material 311S is a heavy webbing and turns under the foot so that the foot can sit on both the webbing and the shelter/tent floor. The diameter of the inside opening of the ring 311R is preferably slightly larger than the diameter of the portion 311-3 so that the ring fits thereover when the plane thereof is perpendicular to the axis A of the tent foot 311, but which locks in the section 311-2 by tension forces within the cover 200 that causes the ring 311 R to tilt and thus become locked within the section 311-2 as shown in FIG. 17. In contrast to common tents, no additional clips or other locking elements are required to engage the tent feet below the ring 311R.

Among other things, the present invention thus provides substantial benefits including ease in use and assembly. The preferred design of the tent feet in combination with the reinforcement members also allows sheet material walls and floors of the shelter/tent to be locked onto the frame quickly and to be easily removed therefrom. Among other things, this allows the user to (a) assemble the shelter/tent without having to deal with loose parts or separate implements and to (b) have multiple or different covers that can be attached and removed to provide for a wide range of needs. For example, a single frame design can accommodate one or more of a recreational tent cover, an ice fishing tent cover, a cabana cover, and/or any other desired cover. Notably, the covers can have different materials (such as with different weights, strengths, waterproof qualities, visibility, heat retention and other properties, etc.), different wall and floor arrangements (such as with or without a floor and/or with or without one or more side, etc.), etc. In addition, the manner in which the tent feet can lock into the corners (e.g., with a ring 311R or other receiving member and the tent foot 311) of the shelter/tent as the frame imparts an outward force against the cover 200 can create a more rigid "unibody" type of structure.

Although less preferred, the tent feet 311 can also be made to penetrate the floor 220 and contact the ground. In other embodiments, the tent feet 311 can also be mounted on or fixed to floor surfaces of boats, trucks, buildings, prefabricated floors, etc. Although the FIGS. illustrate preferred tent feet 311, it is contemplated that any known tent feet could be used or any known tube end could be used. Alternately, such tent feet or tube ends can be omitted entirely if desired.

Figure 11E:
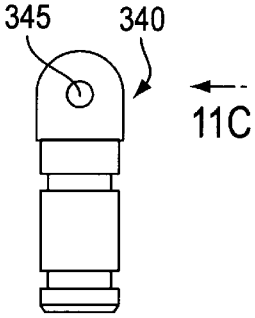
Figure 12:
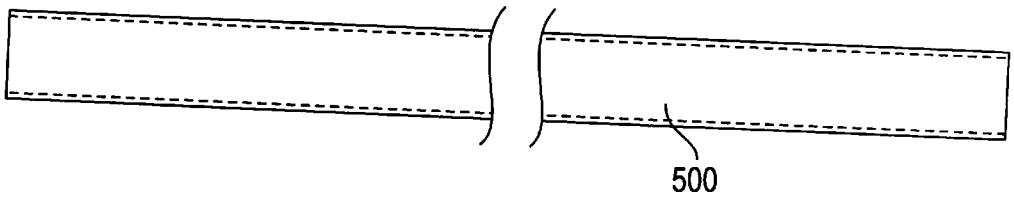
FIG. 12 is a plan view of a support bar or center tube according to one exemplary embodiment of the invention.

As shown in FIGS. 1(A)–1(C) and 12, the hinge 450 supported on the band bar 320 pivotally supports an outer end of a center tube 500. Another connecting member 340 like that shown in FIGS. 11(A)–11(E) is supported at the hinge 450 via the mounting holes 451 upon a pin, bolt or the like (not shown) fitted through the holes 451 and 345 such that the member 343 freely pivots therearound. The end 343 preferably does not contact the surface 453 so that the member 340 pivots freely through an angle of about 180 degrees or more. Most preferably, the end 343 of the connecting member 340 supported at the hinge 450 is completely rounded, such as shown in FIG. 11(E).

The inner ends of the center tubes 500 preferably include like connecting members 340 to connect the center tubes to the bar mounts of the lower clevis 600 in a similar manner to the connection of the members 330 to the bar mounts of the upper clevis 400.

Figure 1D:
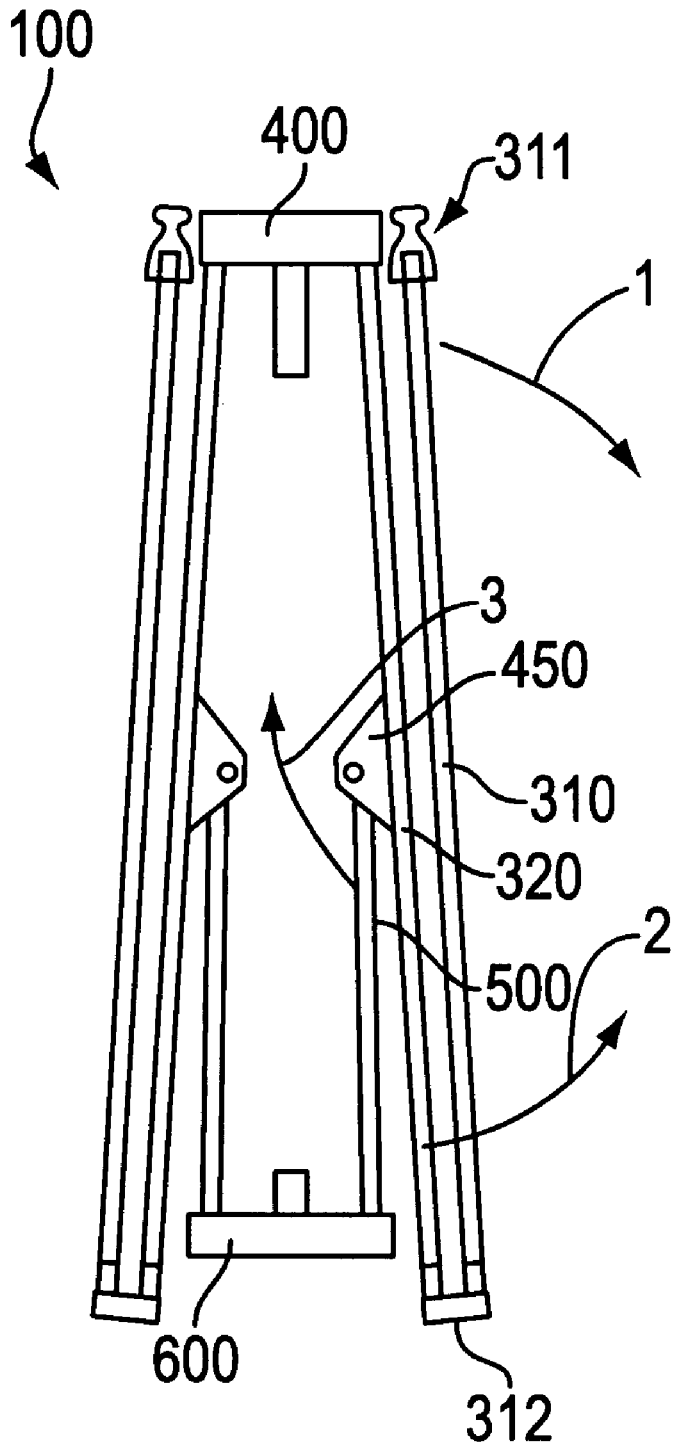
FIG. 1(D) is a schematic side view of a frame structure according to one embodiment of the invention in a collapsed state.

Operation:

In order to erect the shelter/tent, from an initially collapsed state shown schematically in FIG. 1(D), a user can begin by moving the leg tubes 310 downward in the direction of the arrow 1. Then, the user can raise the band bars 320 in the direction of the arrow 2. This action of raising the band bars causes the center tubes 500 to elevate in the direction of the arrow 3. As the center tubes 500 approach a horizontal position, the outer ends of the center tubes 500 push against the cover 200 that is supported on the legs 300. This pressure against the cover 200 causes the legs 300 to flex and to thus store potential energy (the cover 200 can also be made to store energy if desired). Since the leg tube 310 has already been turned downward, the outward force of the center tubes 500 also creates pressure that further forces the leg tube 310 in the direction of the arrow 1 and forces the hinge 312 to its fully opened state, such as shown for example in FIG. 1.

Once the lower clevis 600 has been moved upward a certain distance, the user can place one hand under the lower clevis 600 and the other hand above the upper clevis 400 and can push the clevises together to a point whereat the locking mechanism 700 can lock the clevises together. As noted, after the center tubes 500 are lifted past approximately the horizontal axis, the lower clevis 600 is forced upward towards the upper clevis 400.

Because the upper and lower clevises are securely locked together via the locking mechanism 700, the center tubes 500 do not necessarily need to be raised substantially above the horizontal axis. Nevertheless, it is preferred that the center tubes 500 are raised above the horizontal axis at least a distance to ensure that an upward force is imparted to the lower clevis that further holds the clevis members together.

In use, because the frame is securely locked via the locking mechanism 700, a user can also freely utilize the center tubes of the shelter/tent to hang items, such as clothes, bags, lights, lanterns, partitions, hanging implements, etc.

Erection Facilitating Assembly:

Another method for erecting such a shelter/tent is shown in FIGS. 20–23. In particular, a novel device is provided for erecting a shelter/tent of the present invention. The device is particularly beneficial in facilitating erection of larger shelters/tents, but it can also be utilized with other shelter/tent sizes.

One of the challenges associated with the assembly of shelters/tents relates to the difficulties one encounters in erecting larger models. For example, a structure could be made that may be too tall for a user to easily manipulate the upper and lower clevises. In addition, larger structures could possess greater strengths in their component parts that would make assembly of larger models more difficult and problematic when energy inherent in the component parts cannot be easily controlled throughout the assembly and/or take down processes.

The erection device shown in FIGS. 20–23, however, facilitates assembly of such shelters/tents. In fact, the illustrated erection device can enable a single individual, even a small individual, to easily assemble a relatively large structure. For example, the device enables even a single individual to assemble large shelters/tents that could otherwise require more than one individual, and even a ladder, to be assembled. These benefits appreciably expand the uses and applications of shelters/tents according to the present invention.

Figure 20:
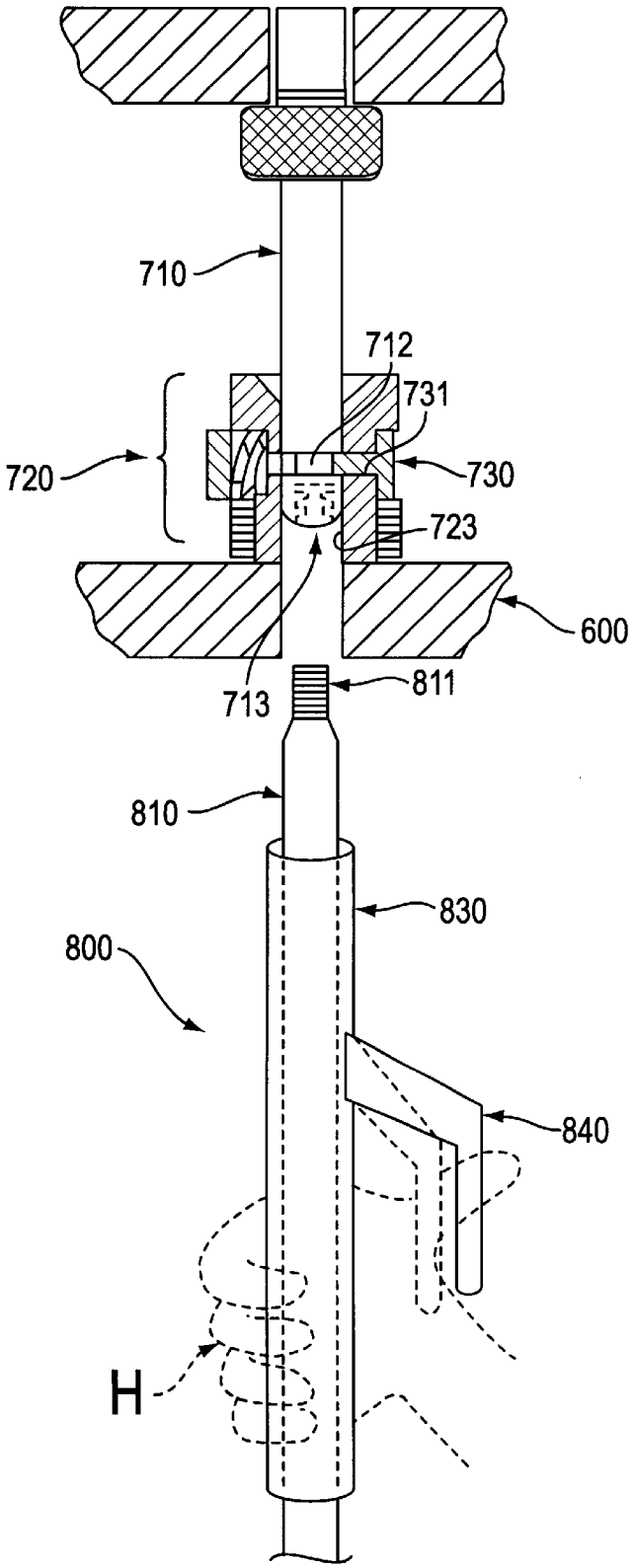
FIG. 20 is a partly cross-sectional side view of an erection device and an assembled locking mechanism of a shelter/tent that is erected and/or disassembled via the erection device.
Figure 21:
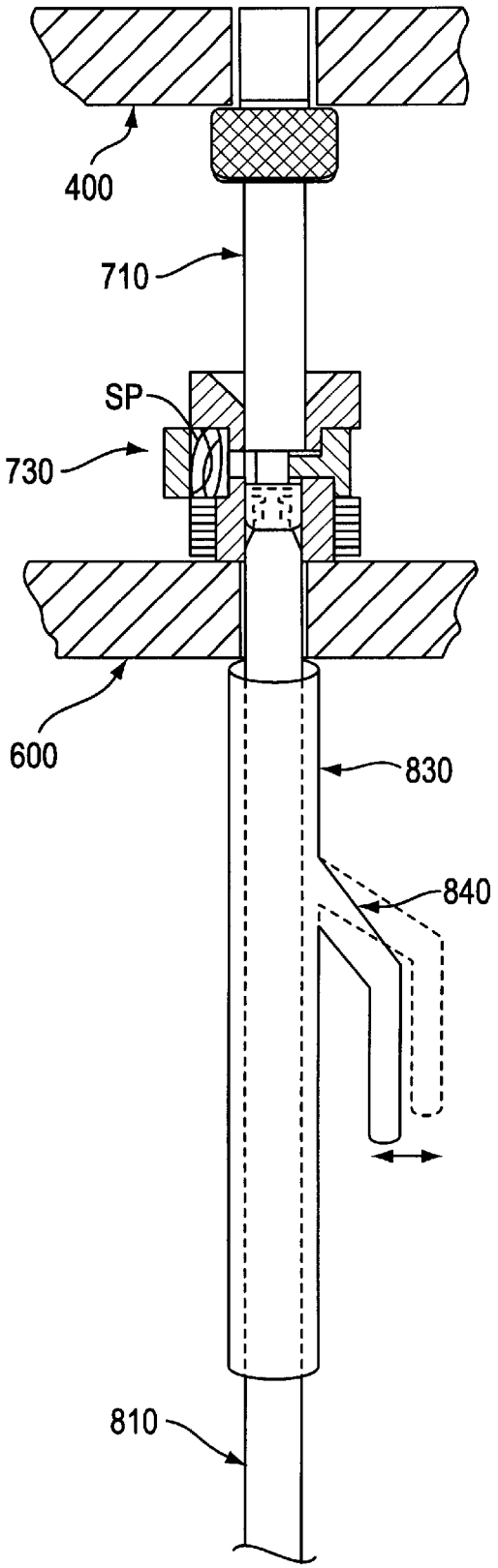
FIG. 21 is a partly cross-sectional side view of the erection device shown in FIG. 20 engaged with the locking mechanism of the shelter/tent shown in FIG. 20.
Figure 22:
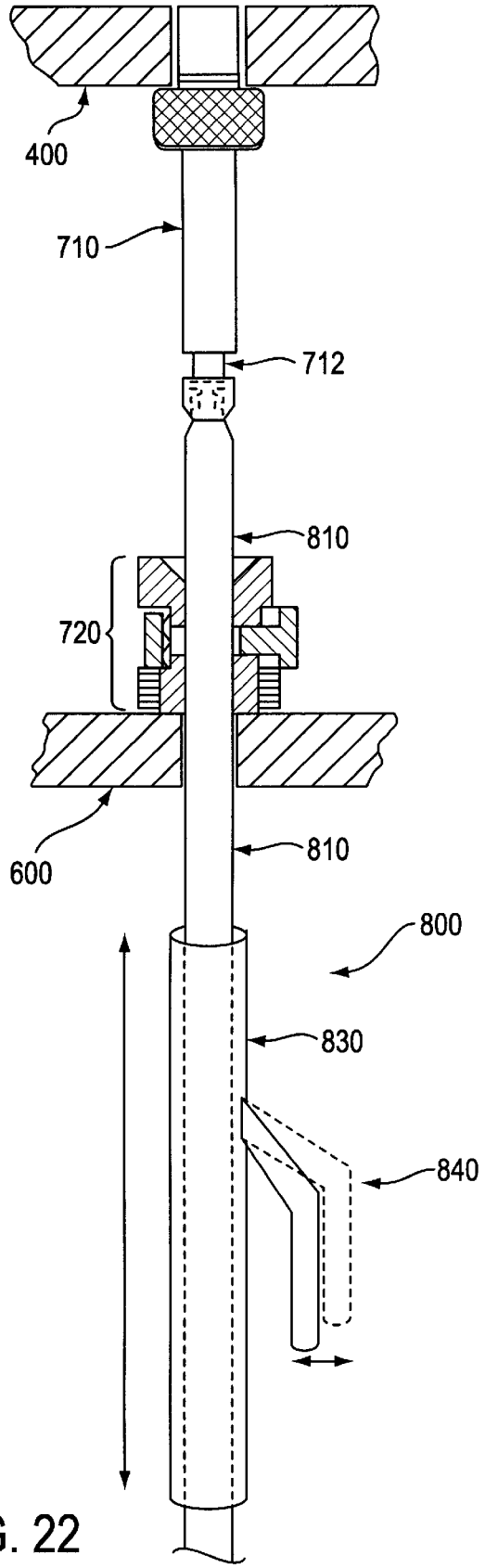
FIG. 22 is a partly cross-sectional side view of the erection device shown in FIG. 20 engaged with the locking mechanism of the shelter/tent shown in FIG. 20 and having separated the upper and lower clevises a limited distance.

As shown in FIGS. 20–22, the erection device 800 includes an assembly pole 810 having an externally threaded tip 811. The tip 811 is configured to threadingly engage an internally threaded bore 713 at the lower end of the pin 710. To provide access to the pin 710, the bore 723 in the socket 720 extends through the bottom of the socket and the lower clevis 600. The pole 810 also includes a slide tube 830 supported there-around that is adapted to move up and down along the pole 810. The slide tube 830 also has a lock lever 840 that locks the slide tube 830 at a particular position along the pole 810. The slide tube 830 and the lock lever 840 can be constructed in a variety of ways. For example, the lock lever 840 can include a spring mechanism (not shown) that biases a friction element (not shown) into contact with the pole 810 to lock the slide tube 830 in position when no external force is applied, and the lock lever 840 can be used to move the friction element away from the pole 810 against the force of the spring mechanism to allow the slide 830 to move along the pole 810. Preferably, when the lock lever 840 is moved inward to a position shown in dashed lines in FIG. 20 (e.g., with one's hand H), the slide tube 830 is released to allow the slide tube 830 to move freely up or down the assembly pole 810, and when the lock lever is moved to the outward position shown in solid lines in FIG. 21 the position of the slide tube 830 is locked.

In operation, the pole 810 and the slide tube 830 can be used both to erect and to disassemble the shelter/tent structure.

The use of the pole and slide to disassemble (i.e., collapse or take down) the structure will be described first. As shown in FIG. 20, to disassemble the frame when the upper and lower clevises are connected, the threaded tip 811 of the assembly pole 810 can be inserted vertically into the hole in the lower clevis 600. Then, as shown in FIG. 21, the tip 811 can be screwed into the internal threads 713 of the locking pin 710 to connect the pole 810 to the pin 710. Although a threaded engagement is preferred, it is contemplated that other known engagements can be used between the pole 810 and the pin 710. Most preferably, however, the engagement is imparted and released by merely rotating the pole 810 with respect to the pin 710. After the pole 810 is engaged with the pin 710, the slide tube 830 can be moved vertically up the pole 810 until it touches the bottom of the lower clevis 600 as shown in FIG. 21. As shown in FIG. 22, the ring 730 can then be moved laterally to release the pin 731 from the groove 712 to unlock the vertical pin 710 from the socket 720 mounted on the lower clevis 600. When the pin 731 is released, the upward force caused by pressure of the legs 300 against the sheet material walls of the tent/shelter alone holds the upper clevis 400 and the lower clevis 600 together.

Then, with one hand the user can grasp the lock lever 840 while holding the slide tube 830 against the bottom of the lower clevis 600. Simultaneously, the user can also use his or her other hand to grasp the assembly pole 810 below the slide tube and gently push the assembly pole 810 upward through the slide tube 830 and through the lower clevis 600. Because of the union of the assembly pole 810 and the locking pin 710, this action can thus move the upper clevis 400 away from the lower clevis 600.

When the upper clevis 400 moves away a certain distance from the lower clevis 600, the structure of the frame system will cause the upper clevis 400 to seek to accelerate away from the lower clevis 600 for a considerable distance until the energy of the frame system dissipates when the legs 300 of the frame are relaxed and free from tension against the cover 200. The user can control the release of stored energy within the frame which seeks to accelerate the separation of the upper clevis 400 from the lower clevis 600 by braking downward motion of the lower clevis 600 via the lock lever 840 and by braking upward motion of the upper clevis 400 by manipulating the assembly pole 810 and by controlling the speed that the assembly pole 810 passes up through the lower clevis 600.

Figure 23A:
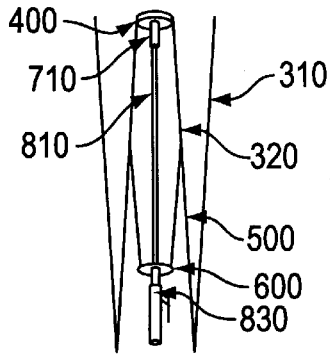
FIGS. 23(A)–23(G) are schematic illustrations of one method for erecting a shelter/tent with the erection device shown in FIGS. 20–22.

Once the upper clevis 400 and lower clevis 600 no longer accelerate away from each other, the user can move the slide assembly tube 830 down to a low point on the assembly pole 810 and can release the lock lever 840 to lock the slide assembly tube 830 at that low point. The remainder of the shelter/tent frame assembly can then be collapsed around the assembly pole 810, such as shown in FIG. 23(A). The assembly pole 810 and the slide tube 830 can thus conveniently remain attached to the frame during storage. Among other things, this reduces the likelihood of loss of such parts and also facilitates expeditious assembly of the structure.

Figure 23B:
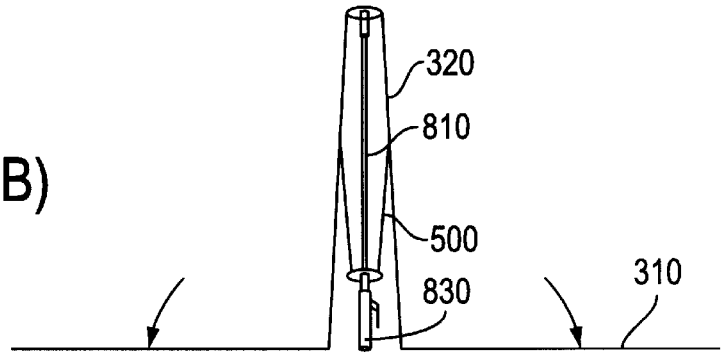
Figure 23C:
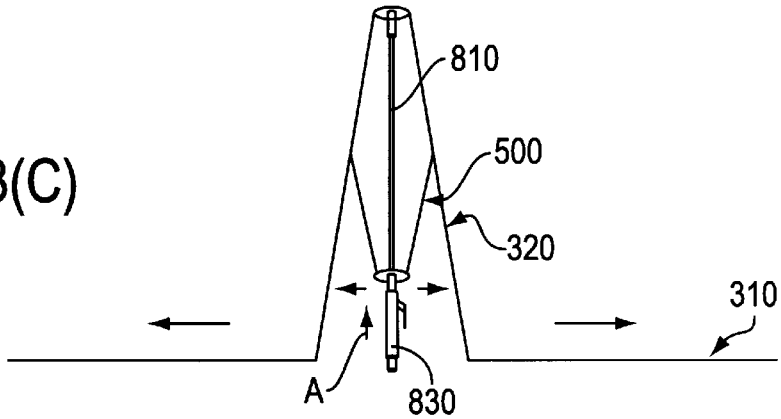
Figure 23D:
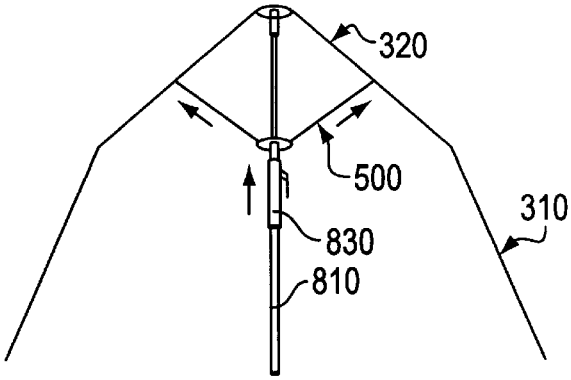
Figure 23E:
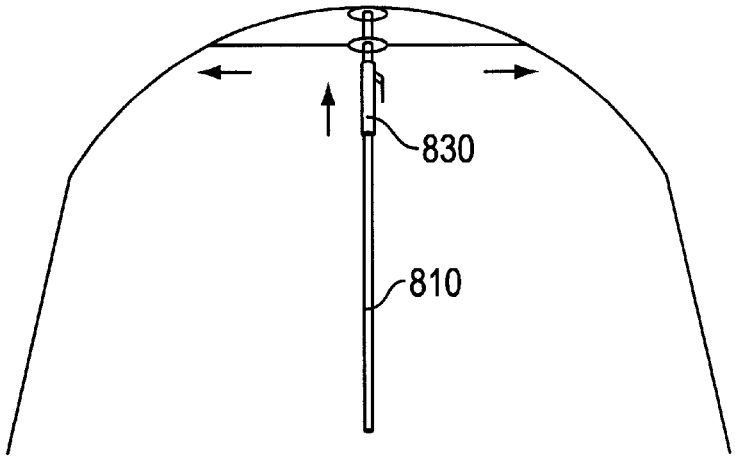
Figure 23F:
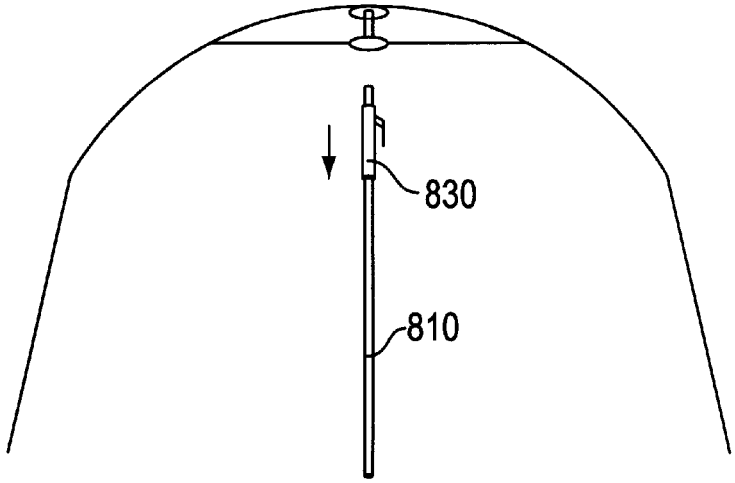
Figure 23G:
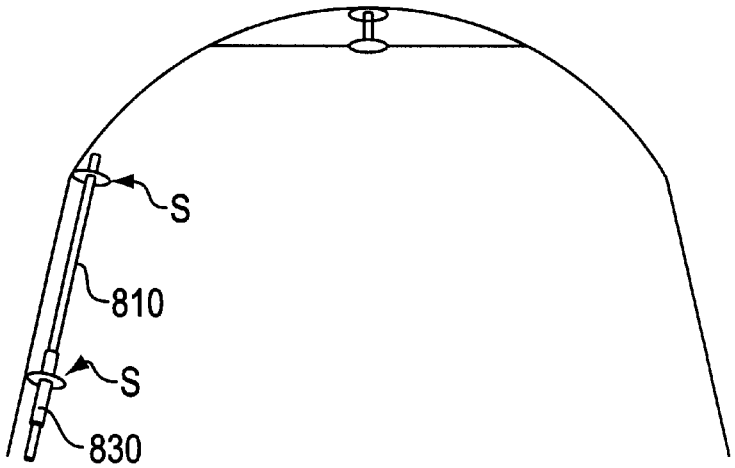

In order to assemble the shelter/tent, the process is simply reversed. FIGS. 23(A)–23(G) schematically illustrate stages during the erection of the shelter/tent. As shown in FIG. 23(A), the shelter/tent is initially fully collapsed. Then, as shown in FIG. 23(B), the leg tubes 310 are lowered. Then, as shown in FIG. 23(C), the user begins to raise the slide assembly tube 830 which, in turn, causes the lower clevis 600 to elevate and to lift the band bars 320 as shown in FIG. 23(D). Once the upper and lower clevises are engaged via the locking mechanism 700, such as shown in FIG. 23(E), the pole 810 and tube 830 assembly is unscrewed, FIG. 23(F), and removed for storage, The pole 810 and tube 830 can be easily stored until it is needed again for disassembly. In one exemplary embodiment shown in FIG. 23(G), supports S, such as straps or the like, can be attached along a side wall, or preferably at a corner between two side walls of the tent or along the floor proximate the juncture between the floor and the wall to retain the pole 810 and the tube 830 out of the way during use. When straps are used, the straps can be opened and closed via hook and loop fastening fabric, buttons or the like to retain the pole 810.

Although the erection device 800 has been described in conjunction with a shelter/tent having a locking mechanism 700 similar to that shown in FIGS. 2(A), it should be understood that the erection device 800 can be used in conjunction with a shelter/tent having a locking mechanism 700 like that of any of the embodiments described herein. Those skilled in the art should recognize how to modify such embodiments to accommodate such an erection device. Alternatively, the present erection device 800 could also be used in conjunction with a shelter/tent that does not include such a locking mechanism, such as for example with a shelter/tent similar to that shown in U.S. Pat. No. 4,945,936, the disclosure of which is incorporated herein by reference. Although the assembly pole 810 has been described as a single elongated pole, the pole 810 can also be constructed from two or more pole segments (not shown) that are connected end-to-end (such as via male and female threads) to create a single pole 810. In this manner, the pole 810 can be broken down (i.e., disassembled) for placement within a back-pack, for storage or the like.

Additional Frame Structures:

As noted herein-above, various aspects of the present invention are not limited to frame structures exactly as described. As some examples, the locking mechanisms 700 and the erection device 800 can be used with a variety of other frame structures having upper and lower clevises.

Other frame structures are illustrated, for example, in FIGS. 18–19.

Figure 18A:
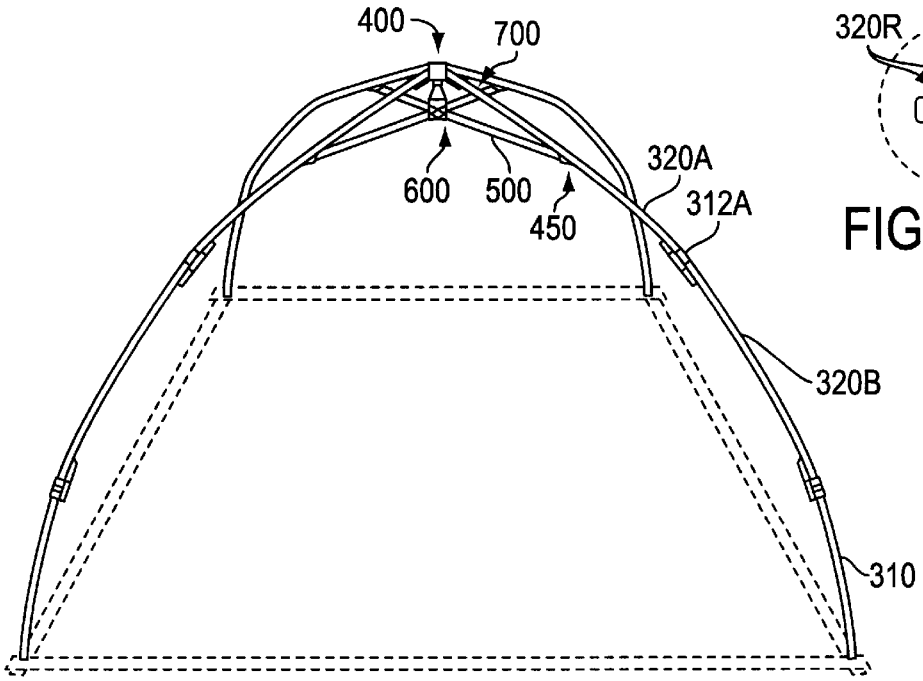
FIG. 18(A) is an elevational view of a shelter/tent frame in an assembled state according to another embodiment of the invention.
Figure 18C:
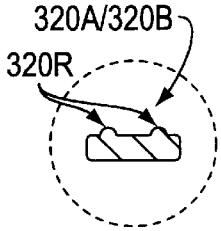
FIG. 18(C) is a cross-section of a band bar that useable in the embodiment shown in FIG. 18(A)
Figure 18B:
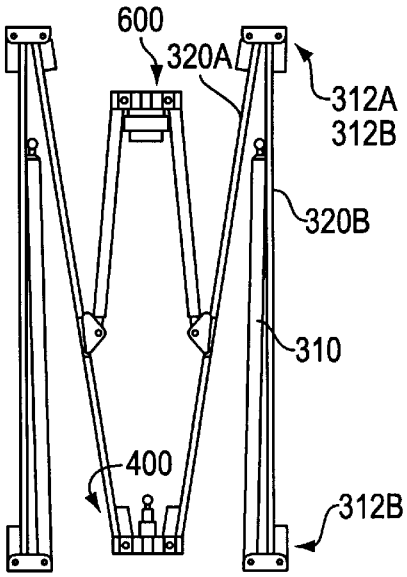
FIG. 18(B) is a side view of the shelter/tent shown in FIG. 18(A) in a collapsed state.
Figure 18D:
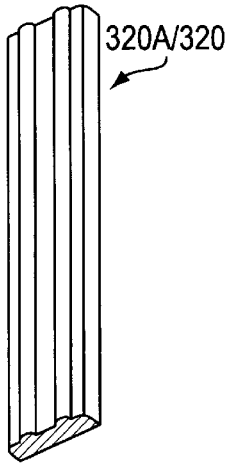
FIG. 18(D) is a perspective view of a section of the band bar shown in FIG. 18(C)

FIGS. 18(A)–18(C) show an embodiment having four modified legs (as noted, the number of legs can be selected as desired). In the illustrated embodiment, each leg includes three leg segments 310, 320A and 320B, and there are two intermediate folding hinges 312A and 312B. If desired a locking mechanism can be added to the hinges to securely hold the frame in the erected position once assembled. As shown, the band bars 320A and 320B are preferably formed with a plurality of longitudinal ribs 320 R extending along the length of the band bars as shown in FIGS. 18(C) and 18(E). Preferably, two ribs are provided. Among other things, this allows the band bars 320A and 320B to impart a greater flex-action and thus allows for a wider range of designs. In one exemplary embodiment, the band bars 320A and 320B can be extruded into this form, such as being made of extruded aluminum. It is contemplated that any of the embodiments discussed herein can include this type of band bar structure and/or such extruded materials. It again noted that the various leg segments, shapes, etc., can be varied extensively between embodiments, and that the illustrated and described embodiments are merely exemplary designs.

Figures 19A, 19B:
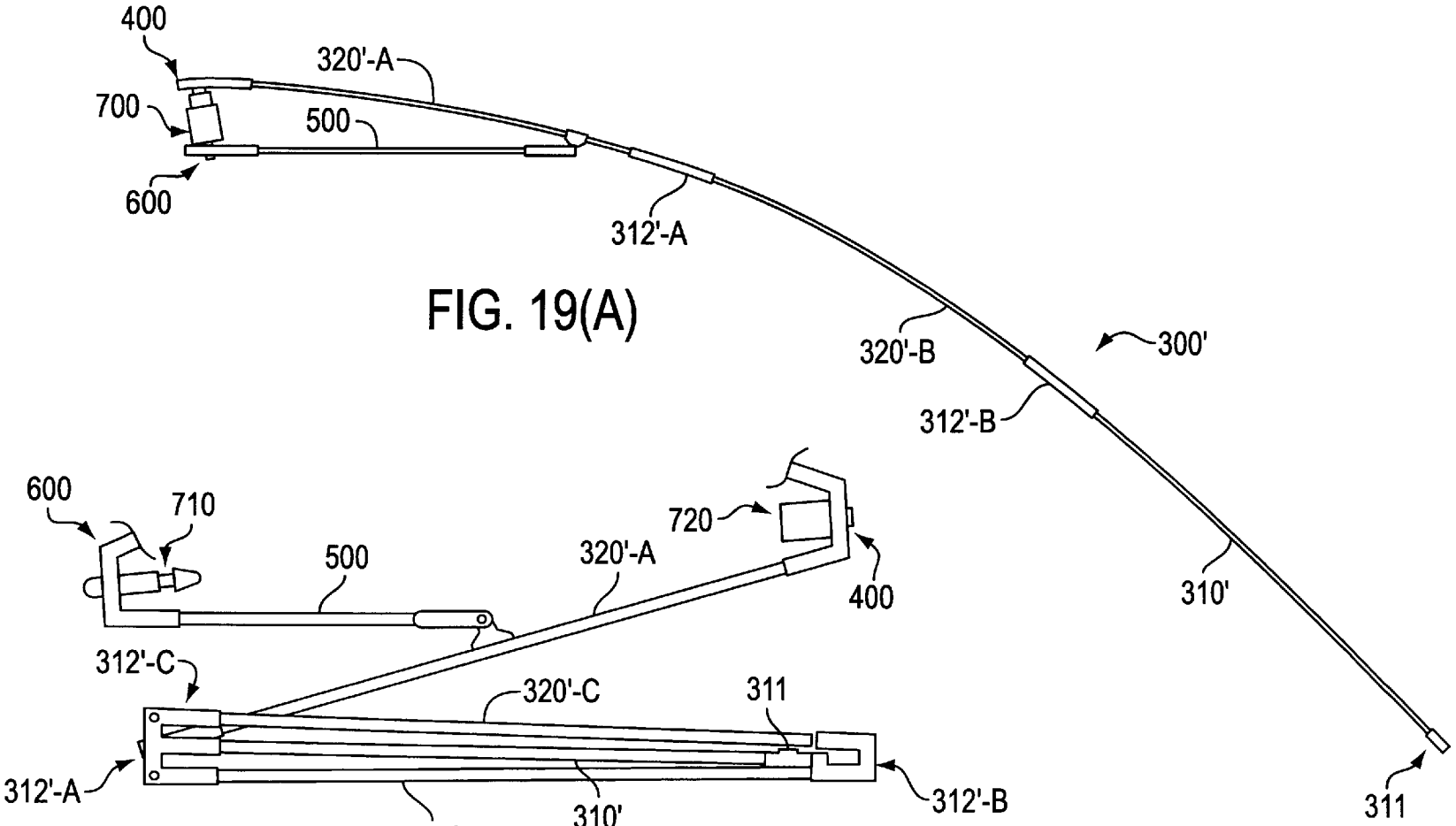
FIG. 19(A) is a schematic side view of a section of a shelter/tent frame in an assembled state according to another embodiment of the invention.
FIG. 19(B) is a schematic side view of a section of a shelter/tent frame in a collapsed state according to yet another embodiment of the invention.

The embodiment shown in FIG. 19(A) is similar to that shown in FIG. 18(A) and includes a frame having legs 300' (only one leg shown) with three leg segments 310', 320'-A and 320'-B and with two intermediate hinges 312'-B and 312'-A. This embodiment enables, for example, the frame to be collapsed into a smaller size. As a result, the device can be used, for example, to create shelters/tents that can be easily carried within a common back-pack carried by a user. As shown in the exemplary dimensions in inches in FIG. 19(A), a substantial shelter/tent size can be created that folds into a small structure (the largest leg segment length of the exemplary embodiment shown being about 23 inches). Once again, the exemplary dimensions are for illustrative purposes only.

The embodiment shown in FIG. 19(B) is similar to that shown in FIG. 19(A), except that FIG. 19(B) includes four leg segments 310', 320'-A, 320'-B and 320'-C. As shown, the device preferably collapses to a state wherein the maximum height H is determined approximately by the relative positions of the upper and lower devises in the fully collapsed state. The embodiment shown in FIG. 19(B) also shows a modified locking mechanism wherein a socket 720 extends from the upper clevis and a pin 710 extends from the lower clevis 600.

Figure 19C:
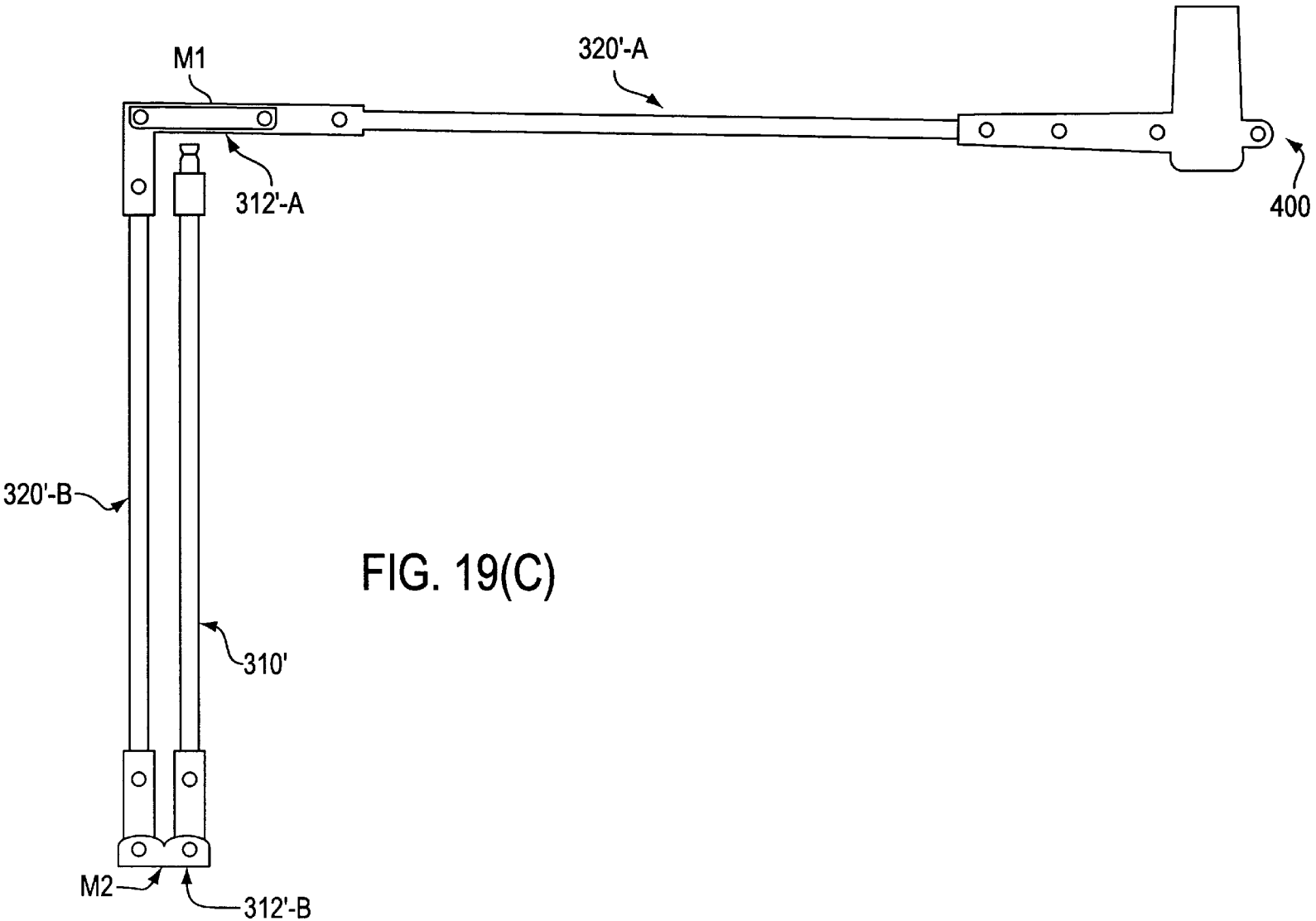
FIG. 19(C) is a schematic side view of a section of a shelter/tent frame in a partially-collapsed state according to yet another embodiment of the invention.

The embodiment shown in FIG. 19(C) is similar to the embodiment shown in FIG. 19(A), except that the middle segment M1 of the hinge 312'-A is longer than the middle segment M2 of the hinge 312'-B to facilitate compact folding of the structure.

Additional Modifications and Embodiments:

The features of the present invention described hereinabove enable the creation of easily operated, quickly erectable, highly secure and/or large shelter/tent structures. Accordingly, the present invention has greater applicability and benefits in a variety of circumstances. For example, as discussed above, the present invention is also highly beneficial in military and disaster relief applications.

The present invention could also be used to create even larger structures by incorporating multiple shelter/tent structures in side-by-side relationship and connecting adjacent sides of adjacent shelters/tents, such as via common door openings D. Because the present invention enables the formation of larger shelters/tents, the combination of multiple shelters/tents in side-by-side relationships enables the creation of large facilities for many applications. For example, persons at camping sites can attach a plurality of private tents to a single common tent area. As another example, in disaster relief situations large elongated structures can be created by connecting a plurality of such structures in a row. Other multiple shelter/tent arrangements can be beneficial in the creation of temporary health care centers. It is notable that the present invention, including the locking mechanism 700 also enables the sides 210, FIG. 1, to be formed at a steeper angle (i.e., closer to vertical) which greatly facilitates and enables the connection of multiple shelters/tents and advantageously provides a larger useable space per unit floor area than other shelters/tents.

While the preferred embodiments of the invention have been described herein-above, it should be understood that various modifications to the preferred embodiments can be made based on this disclosure and the knowledge of those in the art. All such modifications are also encompassed within the scope of the present invention. As some examples, various aspects of embodiments described above can be incorporated into other embodiments described above, and various other modifications can be made as would be understood by those in the art based on this disclosure.

What is claimed is:

1. A collapsible shelter/tent, comprising:

a first clevis;

three or more legs pivotally connected to said first clevis;

a second clevis;

three or more support bars, each pivotally connected with respect to one of said legs at an outer end of said support bar and pivotally connected to said second clevis at an inner end of said support bar, said legs, said support bars, and said first and second devises forming a collapsible frame;

a generally vertical pin extending from one of said first and second clevises, said generally vertical pin having a groove on a side thereof;

a socket disposed on the other of said first and second clevises, said socket having a receiving bore formed therein which is aligned with said generally vertical pin, said socket having an engaging member supported therewithin, said engaging member being constructed and arranged to firmly engage said groove in said generally vertical pin after said generally vertical pin is inserted into said bore of said socket to thereby lock said first and second clevises together and to be manually disengaged from said groove to permit said first and second clevises to be separated from one another; and a plurality of sheet-material walls supported on said collapsible frame in collapsed and uncollapsed states of said frame, said plurality of sheet-material walls being constructed and arranged to apply pressure to portions of said collapsible frame as said collapsible frame is moved from said collapsed state to said uncollapsed state to cause portions of said collapsible frame to flex and thereby urge one of said first and second clevises toward the other when said collapsible frame is in the uncollapsed state.

2. The collapsible shelter/tent of claim 1, wherein said sheet-material walls include sides around a perimeter of said shelter/tent and a ceiling.

3. The collapsible shelter/tent of claim 2, wherein said sheet-material walls are supported on an outside surface of said frame.

4. The collapsible shelter/tent of claim 1, wherein said socket further includes biasing means for biasing said engaging member into said groove automatically upon engagement of said first and second clevises.

5. The collapsible shelter/tent of claim 4, wherein said biasing means includes at least one spring.

6. The collapsible shelter/tent of claim 4, wherein said biasing means includes a gravitational force on said engaging member.

7. The collapsible shelter/tent of claim 1, wherein said first clevis is above said second clevis and said generally vertical pin extends downward from said first clevis towards said second clevis.

8. The collapsible shelter/tent of claim 7, wherein said engaging member is located proximate said second clevis and is manually movable at a position proximate said second clevis and spaced substantially below said first clevis.

9. The collapsible shelter/tent of claim 8, wherein said socket is fixed to said second clevis and includes a central bore and a widened opening having a funnel-shape receiving surface.

10. The collapsible shelter/tent of claim 9, wherein a diameter across said widened opening having said funnel-shape receiving surface is more than 2 times greater than a diameter across said vertical pin.

11. The collapsible shelter/tent of claim 10, wherein said diameter across said widened opening having said funnel-shape receiving surface is more than 2.5 times greater than said diameter across said vertical pin.

12. The collapsible shelter/tent of claim 11, wherein said diameter across said widened opening having said funnel-shape receiving surface is more than 3 times greater than said diameter across said vertical pin.

13. The collapsible shelter/tent of claim 10, wherein said generally vertical pin is generally cylindrical with a circular cross-section and said diameter across said vertical pin is a diameter across said circular cross-section, and wherein said generally vertical pin has a tapered bottom end.

14. The collapsible shelter/tent of claim 1, wherein one or both of said socket and said engaging member are color coded to identify when said engaging member is in a locked position and to identify when said engaging member is in an unlocked position.

15. A method of erecting a collapsible tent, comprising the steps of:

a) providing a collapsible shelter/tent having:

a collapsible frame that includes: a) three or more legs pivotally connected to a, first clevis; and b) three or more support bars pivotally connected with respect to said legs at an outer end of said support bars and pivotally connected to a second clevis at an inner end of said support bars;

one of said first and second devises having a generally vertical pin extending therefrom, said generally vertical pin having a groove on a side thereof;

the other of said devises having a socket which has a receiving bore aligned with said generally vertical pin, said socket having an engaging member supported therewithin, said engaging member being constructed and arranged to firmly engage said groove in said generally vertical pin after said generally vertical pin is inserted into said bore of said socket to lock said first and second clevises together and to be manually disengaged from said from said groove to permit said first and second clevises to be separated from one another; and a plurality of sheet-material walls supported on said collapsible frame in collapsed an uncollapsed states of said frame, said plurality of sheet-material walls being constructed and arranged to apply pressure to portions of said collapsible frame as said collapsible frame is moved from said collapsed state to said uncollapsed state to cause portions of said collapsible frame to flex and thereby urge one of said first and second clevises toward the other when said collapsible frame is in the uncollapsed state, b) placing said collapsible shelter/tent in a collapsed condition;

c) moving said first and second clevises towards one another against a biasing force tending to separate said clevises created by said legs and said sheet-material walls;

d) upon reaching a certain position, having said legs and said sheet-material walls switch the direction of force on said second clevis so as to force said clevises toward one another; and e) after reaching said certain position, locking said first and second clevises together by inserting said generally vertical pin into said bore of said socket.

16. The method of claim 15, wherein said step e) of locking said clevises together includes automatically biasing said engaging member into said groove upon engagement of said first and-second clevises.

17. The method of claim 15, further including performing said step of automatically biasing said engaging member by at least one spring.

18. The method of claim 15, further including the step of providing said sheet-material walls on an outside surface of said legs, and further including the step of disassembling said shelter/tent by reaching from inside of said shelter/tent and manually moving said engaging member at a position proximate said second clevis member and spaced substantially below said first clevis member.

* * * * *